US009037070B2

(12) United States Patent
Tokuda

(10) Patent No.: US 9,037,070 B2
(45) Date of Patent: May 19, 2015

(54) CLEANING DEVICE AND IMAGE FORMING APPARATUS USING SAME

(71) Applicant: Sharp Kabushiki Kaisha, Osaka (JP)

(72) Inventor: Takashi Tokuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/267,159

(22) Filed: May 1, 2014

(65) Prior Publication Data

US 2014/0356043 A1 Dec. 4, 2014

(30) Foreign Application Priority Data

May 31, 2013 (JP) ..... 2013-115074

(51) Int. Cl.
*G03G 21/00* (2006.01)
*G03G 21/10* (2006.01)

(52) U.S. Cl.
CPC ..... *G03G 21/105* (2013.01); *G03G 21/0011* (2013.01); *G03G 21/10* (2013.01)

(58) Field of Classification Search
CPC ..... G03G 21/0011; G03G 21/10
USPC ..... 399/358, 99, 101
See application file for complete search history.

(56) References Cited

U.S. PATENT DOCUMENTS

| | | | | |
|---|---|---|---|---|
| 6,622,001 | B2 * | 9/2003 | Arimitsu et al. | 399/358 |
| 2002/0131799 | A1 * | 9/2002 | Kubo | 399/350 |
| 2010/0143011 | A1 * | 6/2010 | Tawada | 399/358 |
| 2013/0108341 | A1 * | 5/2013 | Ikebata et al. | 399/358 |

FOREIGN PATENT DOCUMENTS

| | | |
|---|---|---|
| JP | 58-144873 | 8/1983 |
| JP | 2002-308520 | 10/2002 |
| JP | 2009-109830 | 5/2009 |

OTHER PUBLICATIONS

Machine translation of reference Tachiki (JP 2009-109,830 A), Listed in IDS, Pub date May 21, 2014.*

* cited by examiner

*Primary Examiner* — Rodney Bonnette
(74) *Attorney, Agent, or Firm* — Renner, Otto, Boisselle & Sklar, LLP

(57) ABSTRACT

The intermediate transfer belt cleaning device includes a cleaning blade for removing residual toner on the intermediate transfer belt, a waste toner conveying screw that conveys the removed toner, and a vibrating part with multiple vanes, arranged between the cleaning blade and the waste toner conveying screw, each vane partly coming into contact with the waste toner conveying screw and vibrating in linkage with the motion of the waste toner conveying screw. Each vane has a projected part that is positioned close to, and projects toward, the intermediate transfer belt.

6 Claims, 19 Drawing Sheets

CLEANING DEVICE AND IMAGE FORMING APPARATUS USING SAME

This Nonprovisional application claims priority under 35 U.S.C. §119(a) on Patent Application No. 2013-115074 filed in Japan on 31 May 2013, the entire contents of which are hereby incorporated by reference.

BACKGROUND OF THE INVENTION (1) Field of the Invention

The present invention relates to a cleaning device for cleaning a toner image bearer that supports a toner image formed by electrophotography as well as relating to an image forming apparatus using the same device.

(2) Description of the Prior Art

Conventionally, the image forming apparatus performs electrographic image forming in the following process. First, in the charging step, a rotationally driven photoreceptor drum is electrified by a charger. In the light illumination step, an electrostatic latent image is formed on the photoreceptor drum by illumination of light in accordance with image information. In the toner image forming step, a toner image is formed by adhering toner to the electrostatic latent image by a developing device. In the transfer step, this toner image is transferred via an intermediate transfer medium or directly to a recordingmedium such as a sheet material, paper or the like, to produce an image output.

As for the photoreceptor drum (toner image bearer) on which toner images are formed by the charging, light illuminating and toner image forming steps, the developed image information (toner image) on the photoreceptor drum will not be completely transferred to the paper or the intermediate transfer medium in the transfer stage. The transfer efficiency is usually and roughly estimated to be 85 to 95%, though this depends on the apparatus and the transfer device.

The toner thus left over on the photoreceptor drum remains adhering on the photoreceptor drum after the transfer step, and would exert an adverse effect on the next image forming and degrade print quality.

To deal with this, there has been a conventionally known configuration in which a cleaning device is disposed at a peripheral part of the photoreceptor drum on the downstream side of the transfer station where the toner image is transferred to the intermediate transfer medium, the paper or the like so that the surface of the photoreceptor drum is cleaned by collecting the leftover toner on the photoreceptor drum after transfer of the toner image to the transfer medium and the gathered residual toner is collected into a waste toner box.

For example, the cleaning device disclosed in Patent Document 1 shown below as a prior art technology, includes a cleaning blade for removing residual toner on the photoreceptor drum surface, a film disposed under the cleaning blade to receive the removed residual toner (waste toner) and a waste toner conveying screw for conveying the waste toner and is designed to easily collect waste toner by placing and vibrating the film by putting into contact with the waste toner conveying screw.

However, in the cleaning device disclosed in Patent Document 1, since the film and the waste toner conveying screw come into contact with each other in a large contact area, which increases the load for driving the waste toner conveying screw, there occur other problems such as increase of the driving torque of the motor for driving the waste toner conveying screw and increase in consumption current.

To deal with this, a cleaning device for solving the above problems has been disclosed in Patent Document 2 shown below. The cleaning device disclosed in Patent Document 2 includes a vibrating part formed of a film sheet having a plurality of vanes, which each are formed of a plane with its width laid out approximately perpendicular to the axial direction of the waste toner conveying screw. This vibrating part is arranged between the cleaning blade and the waste toner conveying screw, close to the cleaning blade with the plurality of vanes in abutment with the auger of the waste toner conveying screw. Further, in the cleaning device disclosed in Patent Document 2, the pitch between the vanes and the pitch of the waste toner conveying screw are made different so that the vanes that abut the waste toner conveying screw change as the waste toner conveying screw rotates, whereby the vanes vibrate when the vanes are released to recover their original state from the state of abutment between the vanes and the waste toner conveying screw, which, in turn, vibrate the waste toner on the cleaning blade near the vanes. In this way, in the cleaning device disclosed in Patent Document 2, the increase of the load on the drive motor for driving the waste toner conveying screw can be suppressed by avoiding constant contact between the vibrating part and waste toner conveying screw, to realize energy saving with a lower increase in consumption current.

In the thus configuration cleaning device disclosed in Patent Document 2, collection of the waste toner from the cleaning blade can be promoted by application of vibrations with the vibrating part, it is hence possible to keep the surface of the toner image bearer constantly clean by effecting a fair cleaning function without causing any stagnation of waste toner around the cleaning blade.

[Prior Art Documents]

Patent Document 1:

Japanese Patent Application Laid-open No. S58-144873

Patent Document 2:

Japanese Patent Application Laid-open No. 2009-109830

However, it is impossible for the vibrating member of Patent Document 2 to stir the waste toner near the photoreceptor drum. In particular, there has been the problem that the waste toner near the photoreceptor drum immediately before passage of the cleaning blade cannot be removed clean enough.

SUMMARY OF THE INVENTION

The present invention has been devised in view of the above conventional problems, it is therefore an object of the present invention to provide a cleaning device for use in an image forming apparatus, which can improve the operation efficiency of the waste toner conveying screw in the cleaning process for removing toner left over on the toner image bearer to suppress increase of the load on the drive motor of the waste toner conveying screw, can realize power saving by lowering increase in consumption current and can remove waste toner near the toner image bearer efficiently, as well as providing an image forming apparatus using this cleaning device.

In order to solve the above problems, the cleaning device according to the present invention and the image forming apparatus using this are configured as follows: —

The first aspect of the present invention resides in a cleaning device for cleaning a toner image bearer that supports toner images in an image forming apparatus for forming images by electrophotography, comprising: a cleaning member (for example, a cleaning blade) for removing residual toner on the surface of the toner image bearer; a waste toner conveying member (for example, an agitating and conveying member) for conveying the residual toner removed from the toner image bearer by the cleaning member; and, a vibrating member having a plurality of vanes, disposed between the cleaning member and the waste toner conveying member, the vanes partly coming into contact with the waste toner conveying member and vibrating in linkage with the motion of the waste toner conveying member, and, wherein the individual vanes include a projected part that is positioned close to, and projects toward, the toner image bearer, in the area around which the cleaning member abuts the toner image bearer.

The second aspect of the present invention resides in the cleaning device according to the above first aspect, in which it is preferable that the vibrating member includes supporting parts that support the individual vanes; and, a base part that integrally configures the plurality of vanes and the supporting parts along the waste toner conveying member, and, the vibrating member has a circular arced indentation formed at a boundary between the individual vanes and the supporting part.

The third aspect of the present invention resides in the cleaning device according to the above second aspect, in which it is preferable that the vibrating member has a circular arced indentation formed at a boundary (on the side where the vane is formed) between each of the supporting parts and the base part.

The fourth aspect of the present invention resides in the cleaning device according to any one of the above first to third aspects, in which it is preferable that the individual vanes is formed of a plane approximately perpendicular to the longitudinal direction (for example, the axil direction when the waste toner conveying member is a screw body) of the waste toner conveying member, and, when the cleaning member is put in contact with the toner image bearer, the individual vanes is arranged at the position that the projected part does not interfere with the toner image bearer by abutting part of its portion opposing the toner image bearer to the cleaning member.

The fifth aspect of the present invention resides in the cleaning device according to the above fourth aspect, in which it is preferable that the abutment between the individual vanes and the cleaning member is such that when cleaning member is in contact with the toner image bearer, the edge of the individual vanes come in contact with the edge of the cleaning member, that is, forming point contact therebetween.

The sixth aspect of the present invention resides in an image forming apparatus comprising: an image forming portion for forming images by electrophotography; and, a cleaning device including a cleaning member for removing residual toner on the surface of a toner image bearer that supports a toner image, and a waste toner conveying member for conveying the residual toner removed from the toner image bearer by the cleaning member, and, wherein the cleaning device according to any one of the above first to fifth aspects is employed as the cleaning device.

According to the first to fifth aspects of the present invention, since in the cleaning device the front ends of the vanes can be brought close to the toner image bearer, it is possible to efficiently stir and remove waste toner near the toner image bearer drum.

According to the sixth aspect of the present invention, since in the image forming apparatus it is possible to improve the operation efficiency of the waste toner conveying member to suppress increase of the load on the drive motor of the waste toner conveying member and achieve power saving with a lower increase in consumption current. Further, it is possible to stir and remove waste toner near the toner image bearer efficiently, so that it is possible to keep the surface of the toner image bearer constantly clean by fully removing waste toner before the cleaning member

DESCRIPTION OF THE PREFERRED EMBODIMENTS (The First Embodiment)

The embodiment of the present invention will hereinafter be described in detail with reference to the drawings.

Figure 1:
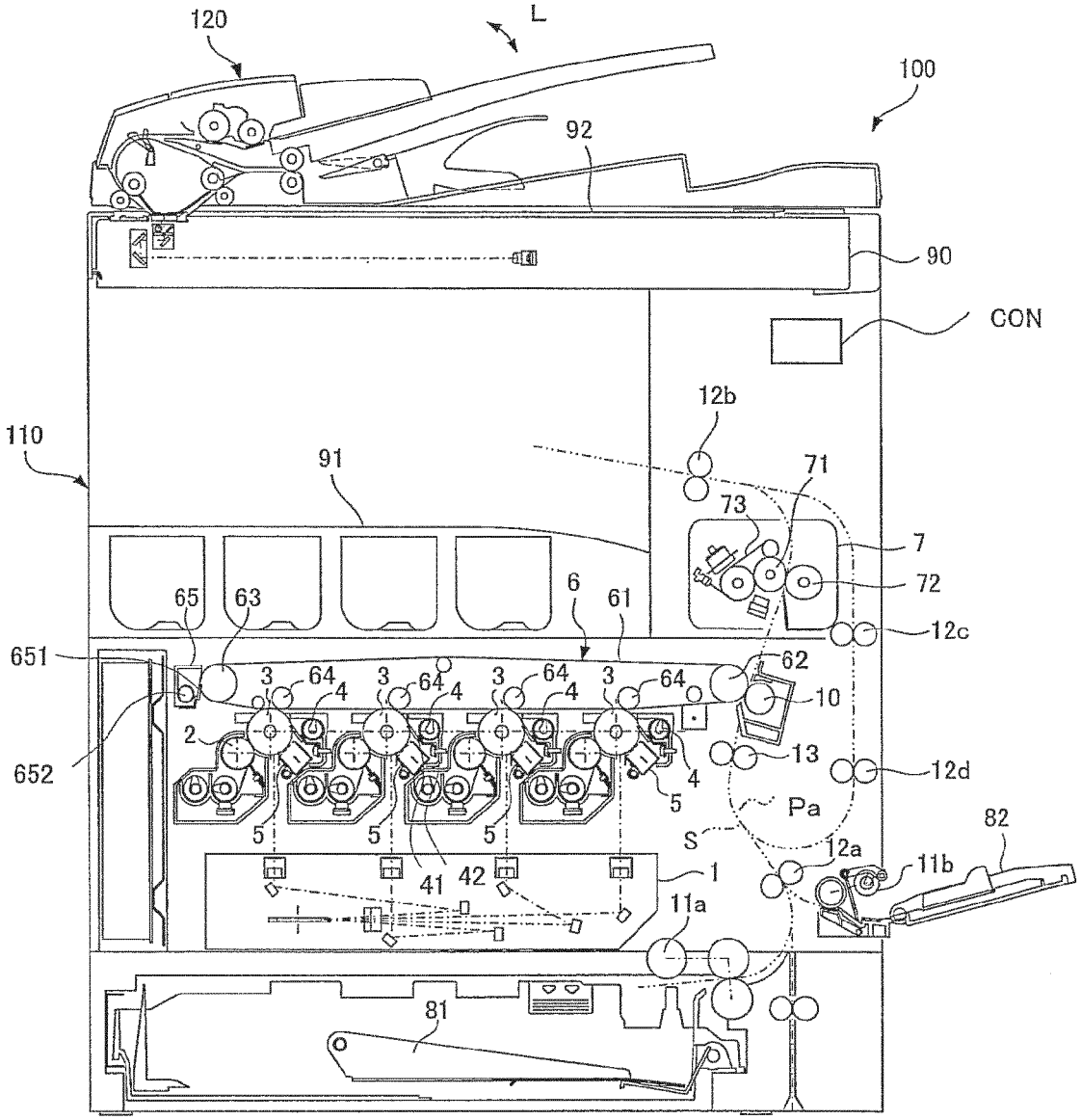
FIG. 1 is an illustrative view showing a configuration of an image forming apparatus using a cleaning device according to the first embodiment of the present invention.

FIG. 1 is an illustrative view of one example of the mode for carrying out the present invention, showing a configuration of an image forming apparatus using a cleaning device according to the first embodiment of the present invention.

As shown in FIG. 1, an image forming apparatus 100 according to the first embodiment forms multi-colored and monochrome images on predetermined sheets (e.g., recording paper) by electrophotography in accordance with image data transmitted from an external device. Image forming apparatus 100 includes an intermediate transfer belt cleaning device (cleaning device) 65 for cleaning an intermediate transfer belt 61 which supports a toner image temporarily. In image forming apparatus 100, the cleaning device according to the present invention is adopted as intermediate transfer belt cleaning device 65.

To begin with, the overall configuration of image forming apparatus 100 according to the first embodiment will be described.

As shown in FIG. 1, image forming apparatus 100 forms multi-colored and monochrome images on predetermined sheets (e.g., recording paper) in accordance with image data transmitted from an external device, and is mainly composed of a main apparatus body 110 and an automatic document processor 120.

Main apparatus body 110 essentially includes: an exposure unit 1; developing units 2, photoreceptor drums 3, cleaner units 4, chargers 5, an intermediate transfer belt unit 6, a fixing unit 7, a paper feed cassette 81 and a paper output tray 91.

An image reader 90 is arranged in the upper part of main apparatus body 110. Mounted on top of the image reader 90 a document table 92 made of a transparent glass plate on which a document is placed. On the top of document table 92, automatic document processor 120 is mounted.

Automatic document processor 120 is configured to automatically feed documents onto document table 92. This automatic document processor 120 is constructed so as to be pivotable in the directions of bidirectional arrow L relative to document table 92 so that a document can be manually placed by opening the top of document table 92.

The image data handled in image forming apparatus 100 is data for color images of four colors, i.e., black (BK), cyan (C), magenta (M) and yellow (Y).

Accordingly, four developing units 2, four photoreceptor drums 3, four chargers 5, four cleaner units 4 are provided to produce four electrostatic latent images corresponding to black, cyan, magenta and yellow. That is, four imaging stations (image forming units) are constructed thereby.

Alternatively, the image forming apparatus may use a six-image station system of six image forming units to form six color images, i.e., further including light cyan (LC) and light magenta (LM) that have the same hues but present light tones of cyan (C) and magenta (M), in addition to four colors, black (BK), cyan (C), magenta (M) and yellow (Y). Use of these six colors can produce clear and more qualified full-color images.

Charger 5 uniformly electrifies the photoreceptor drum 3 surface at a predetermined potential. Other than the corona-discharge type chargers 5, contact type chargers, i.e., roller type or brush type charger may also be used.

Exposure unit 1 is an image writing device that illuminates the electrified photoreceptor drum 3 in accordance with the image data input form without or the image data read out from documents to form electrostatic latent images corresponding to the image data on photoreceptor drum 3 surface.

The exposure unit 1 is constructed as a laser scanning unit (LSU). This exposure unit 1 includes a polygon mirror for scanning a laser beam, optical elements such as lenses and reflection mirrors for leading the laser beam reflected by the polygon mirror to photoreceptor drums 3. As exposure unit 1, other methods using an array of light emitting elements such as an EL or LED writing head, for example may be used instead.

Developing unit 2 visualizes the electrostatic latent images formed on photoreceptor drums 3 with four color (Y, M, C and BK) toners.

photoreceptor drums 3 each have a cylindrical form and are disposed over exposure unit 1. The surface of each photoreceptor drum 3 is cleaned by cleaner unit 4. Then the cleaned surface is uniformly electrified by charger 5.

Cleaner unit 4 removes and collects the toner left over on the photoreceptor drum 3 surface after development and image transfer. Cleaner unit 4 includes a cleaning blade 41 and a waste toner conveying screw 42 (FIGS. 11 to 14 in the second embodiment).

Intermediate transfer belt unit 6 is arranged over photoreceptor drums 3. Intermediate transfer belt unit 6 includes an intermediate transfer belt 61, an intermediate transfer belt drive roller 62, an intermediate transfer belt driven roller 63, intermediate transfer rollers 64, and an intermediate transfer belt cleaning device (cleaning device according to the present invention) 65.

Intermediate transfer belt drive roller 62, intermediate transfer belt driven roller 63 and intermediate transfer rollers 64 are arranged so as to support and tension intermediate transfer belt 61 and circulatively drive the belt.

Intermediate transfer roller 64 applies a transfer bias for transferring the toner image from photoreceptor drum 3 to intermediate transfer belt 61, and four intermediate transfer rollers corresponding to Y, M, C and BK, are arranged at four different places.

Intermediate transfer belt 61 is formed of an endless film of about 100 μm to 150 μm thick and is arranged so as to contact with each photoreceptor drum 3. The toner images of different colors formed on photoreceptor drums 3 are sequentially transferred in layers to intermediate transfer belt 61, forming a color toner image (multi-color toner image) on intermediate transfer belt 61.

Transfer of toner images from photoreceptor drums 3 to intermediate transfer belt 61 is performed by intermediate transfer rollers 64 that are in contact with the rear side of intermediate transfer belt 61. Each intermediate transfer roller 64 is adapted to apply a high-voltage transfer bias (high voltage of a polarity (+) opposite to the polarity (−) of the static charge on the toner) to transfer the toner image.

Intermediate transfer roller 64 is formed of a base shaft made of metal (e.g., stainless steel) having a diameter of 8 to 10 mm and a conductive elastic material (e.g., EPDM (Ethylene-Propylene-Diene Methylene linkage), foamed urethane or the like) coated on the shaft surface. This conductive elastic material enables uniform application of a high voltage to intermediate transfer belt 61.

Though the transfer electrodes in the form of rollers, i.e., intermediate transfer rollers 64, are used in the first embodiment, brush-shaped electrodes or others can also be used instead.

As described above, the visualized toner images corresponding to different colors formed on photoreceptor drums 3 are laid over one after another on intermediate transfer belt 61. The thus laminated toner image is transferred as intermediate transfer belt 62 circulatively moves, to a paper Pa by a transfer roller 10 that is arranged at the contact position between intermediate transfer belt 61 and paper Pa.

In this process, intermediate transfer belt 61 and transfer roller 10 are pressed against each other forming a predetermined nip while a voltage for transferring the toner to the paper, i.e., a high voltage of a polarity (+) opposite to the polarity (−) of the static charge on the toner, is applied to transfer roller 10.

Further, in order to constantly obtain the predetermined nip, either transfer roller 10 or intermediate transfer belt drive roller 62 is formed of a hard material (metal or the like) while the other is formed of a soft material such as an elastic roller or the like (elastic rubber roller, foamed resin roller etc.).

Since, as described above the toner adhering to intermediate transfer belt 61 as the belt comes in contact with photoreceptor drums 3, or the toner which has not been transferred to paper Pa by transfer roller 10 and remains on intermediate transfer belt 61, would cause color contamination of toners in the toner image formed at the next operation, the remaining toner is removed and collected by intermediate transfer belt cleaning device 65.

Intermediate transfer belt cleaning device 65 includes a cleaning blade 651 that comes in contact with intermediate transfer belt 61 and a waste toner conveying screw 652. Cleaning blade 651 is a cleaning member and removes the toner remaining on intermediate transfer belt 61. Waste toner conveying screw 652 conveys residual toner (waste toner) collected by cleaning blade 651 to a collecting container (not shown).

Intermediate transfer belt 61 is supported from its interior side by intermediate transfer belt driven roller 63, at the portion where cleaning blade 651 comes into contact with the belt.

Paper feed cassette 81 is a tray for stacking sheets of paper Pa to be used for image forming and is arranged under exposure unit 1 of main apparatus body 110. Also, sheets of paper Pa to be used for image forming can be also stacked on a manual paper feed cassette 82 arranged outside on the flank of main apparatus body 110.

A paper output tray 91 is a tray that is arranged over and above intermediate transfer belt unit 6 and collects printed sheets of paper Pa facedown.

Main apparatus body 110 further includes a paper feed path S that extends approximately vertically to convey paper Pa from paper feed cassette 81 or manual paper feed cassette 82 to paper output tray 91 by way of transfer roller 10 and fixing unit 7.

Arranged along paper feed path S from paper feed cassette 81 or manual paper feed cassette 82 to paper output tray 91 are pickup rollers 11*a* and 11*b*, a plurality of feed rollers 12*a* to 12*d*, a registration roller 13, transfer roller 10, fixing unit 7 and the like.

Feed rollers 12*a* to 12*d* are small rollers for promoting and assisting conveyance of paper Pa and are arranged at different positions along paper feed path S. Here, since feed roller 12*d* functions as a paper output roller for discharging the paper to paper output tray 91, it is also called paper output roller.

Pickup roller 11*a* is arranged near the end of paper feed cassette 81 so as to pick up one sheet at a time from paper feed cassette 81 and deliver it to paper feed path S.

Pickup roller 11*b* is arranged near the end of manual paper feed cassette 82 so as to pick up one sheet at a time from manual paper feed cassette 82 and deliver it to paper feed path S.

Registration roller 13 has a function that temporarily suspends paper Pa that is conveyed along paper feed path S and delivers the paper Pa toward transfer roller 10 at such a timing that the front end of the paper Pa will meet the front end of the toner image data area (image information) on intermediate transfer belt 61.

Fixing unit 7 includes a heat roller 71 and a pressure roller 72. Heat roller 71 and pressure roller 72 are arranged to rotationally convey paper Pa while nipping the paper therebetween.

Heat roller 71 is adapted to be set at a predetermined fixing temperature by instructions from a controller CON in accordance with the signal from an unillustrated temperature detector. The heat roller has a function of heating and pressing the toner to paper Pa in cooperation with pressure roller 72 so as to thermally fix the multi-color toner image transferred on paper Pa, to the paper Pa by fusing, mixing and pressing it.

Fixing unit 7 further includes an external heating belt 73 for heating heat roller 71 from without.

Similarly to heat roller 71, pressure roller 72 is formed of a cylindrical metal core and an elastic layer formed on the peripheral side of the core. Pressure roller 72 is arranged so as to abut against heat roller 71 with a predetermined pressure.

Next, paper feed path S of paper Pa in image forming apparatus 100 will be described in detail.

As described above, image forming apparatus 100 has paper feed cassette 81 for storing sheets of paper Pa beforehand and manual paper feed cassette 82. In order to deliver paper P from these paper feed cassettes 81 and 82, pickup rollers 11*a* and 11*b* are arranged so as to lead paper Pa, one sheet at a time, to paper feed path S.

When one-sided printing on paper Pa is requested, paper Pa delivered from feed cassettes 81 or 82 is conveyed by feed rollers 12*a* on paper feed path S to registration roller 13, by which the paper is released toward transfer roller 10 at such a timing that the front end of paper Pa meets the front end of the toner image data area (image information) on intermediate transfer belt 61 and then the toner image is transferred to paper Pa.

Thereafter, paper Pa having the toner image transferred thereon passes through fixing unit 7, whereby the unfixed toner on paper Pa is fused by heat and fixed. Then the paper is discharged through feed rollers 12*b* onto paper output tray 91.

On the other hand, when duplex printing on paper Pa is requested, the paper with its one side printed passes through fixing unit 7 and is held at its rear end by feed rollers 12*b*, then the feed rollers 12*b* rotate in reverse so as to lead the paper Pa toward feed rollers 12*c* and 12*d*. Thereafter, the paper passes through registration roller 13 to transfer roller 10, where another toner image is transferred on the rear side of paper Pa. The paper Pa having the toner image transferred on its rear side once again passes through fixing unit 7 so that the unfixed toner image is thermally fused and fixed. Then the paper is discharged through feed rollers 12*b* onto paper output tray 91.

Next, the configuration of intermediate transfer belt cleaning device 65 adopted for image forming apparatus 100 will be described in detail with reference to the drawings.

Figure 2:
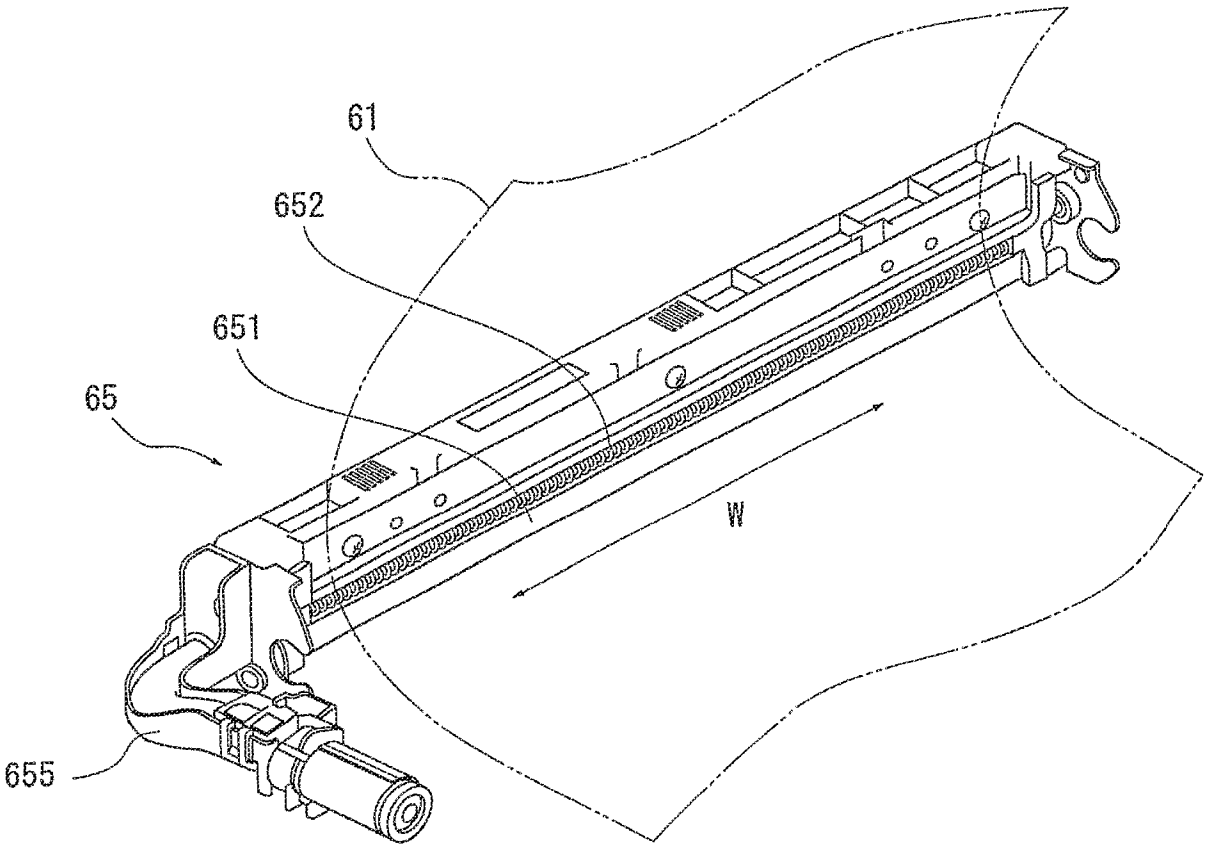
FIG. 2 is a perspective view showing a configuration of an intermediate transfer belt cleaning device according to the first embodiment.
Figure 3:
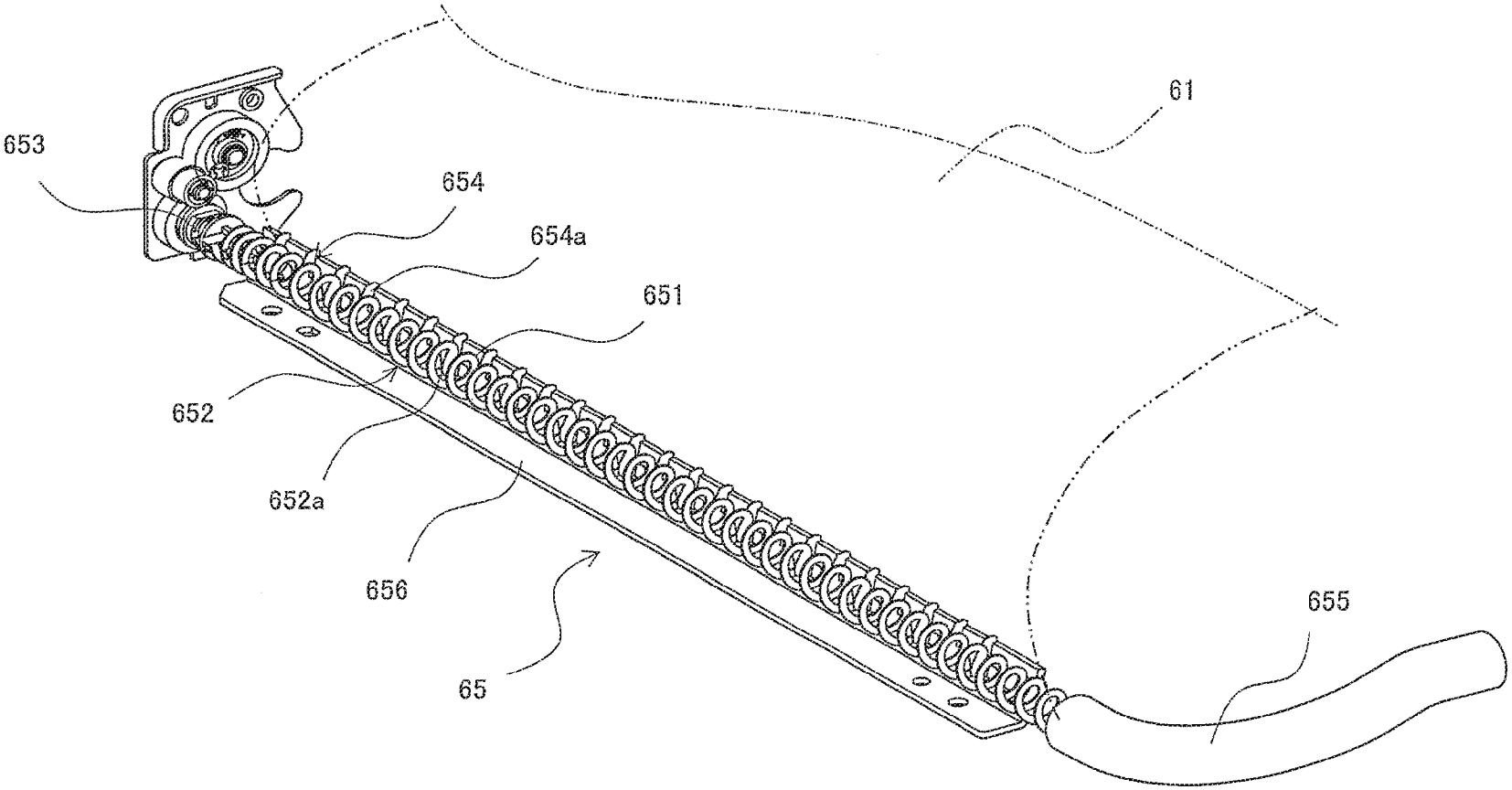
FIG. 3 is an illustrative view showing the internal structure of the intermediate transfer belt cleaning device.
Figure 4:
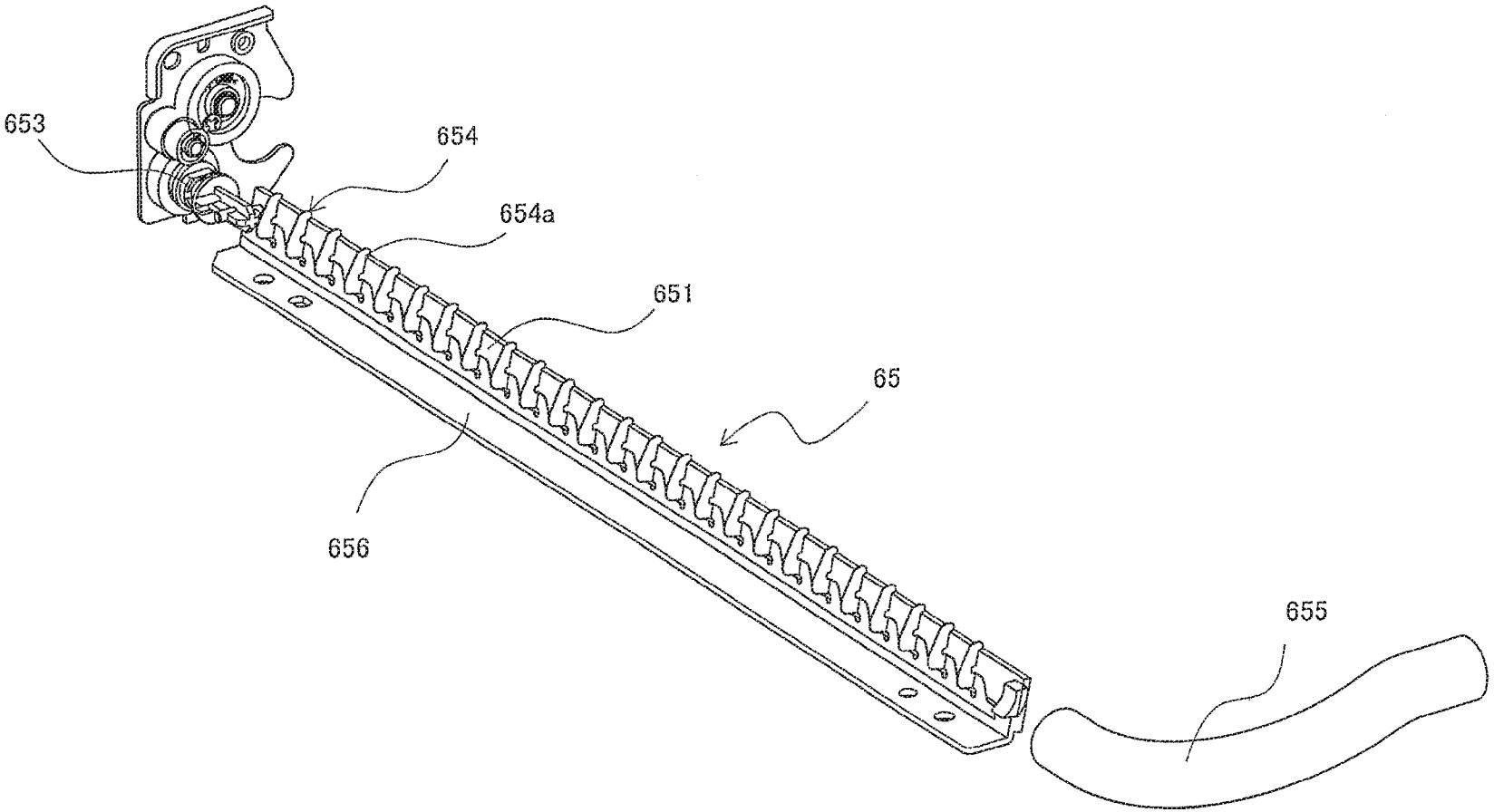
FIG. 4 is an illustrative view showing an attachment state of a cleaning blade and a vibrating part that form the intermediate transfer belt cleaning device.
Figure 5:
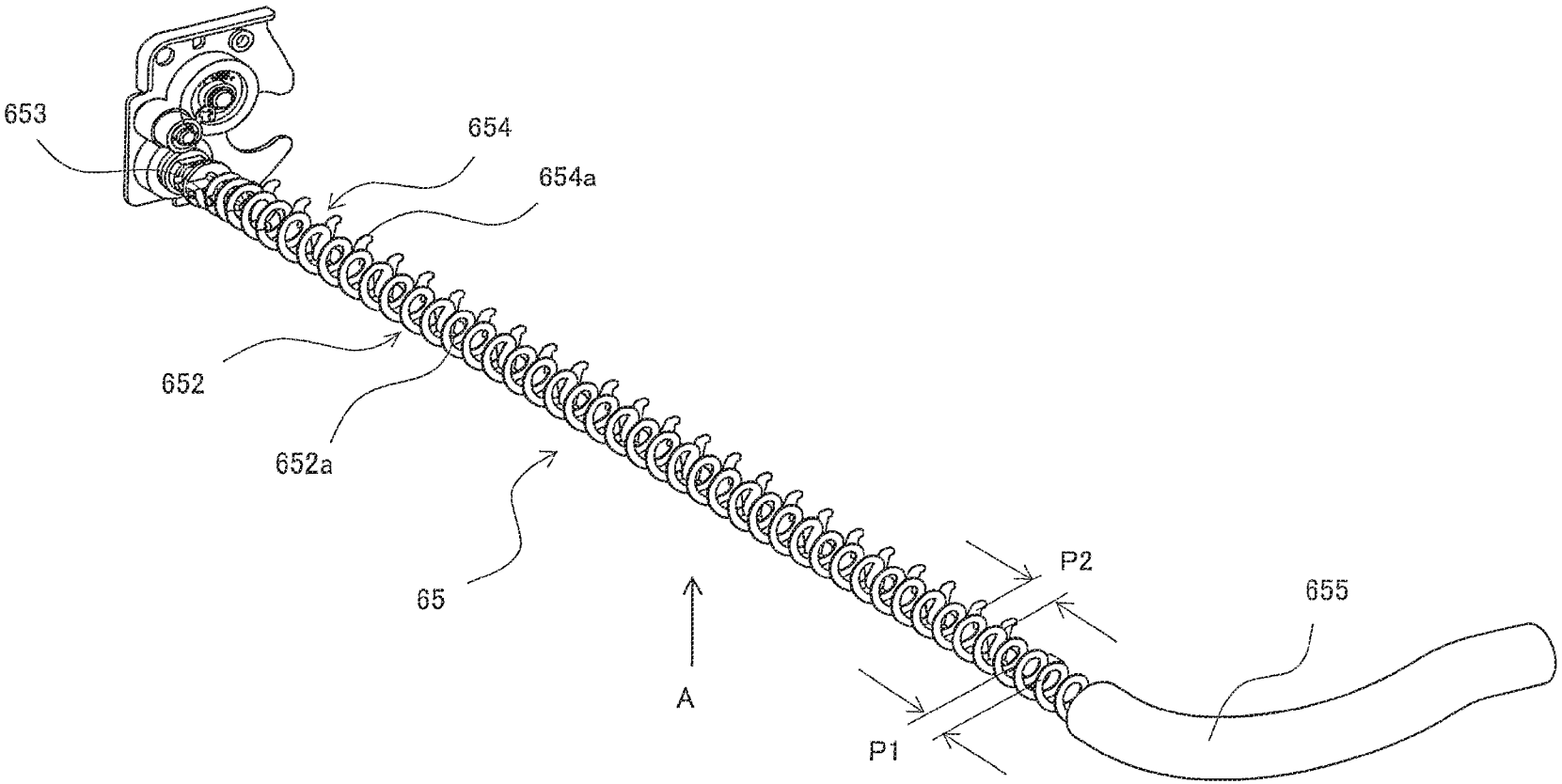
FIG. 5 is an illustrative view showing the positional relationship between a waste toner conveying screw and a vibrating part that form the intermediate transfer belt cleaning device.

FIG. 2 is a perspective view showing a configuration of the intermediate transfer belt cleaning device according to the first embodiment. FIG. 3 is an illustrative view showing the internal structure of the intermediate transfer belt cleaning device. FIG. 4 is an illustrative view showing an attachment state of a cleaning blade and a vibrating part that form the intermediate transfer belt cleaning device. FIG. 5 is an illustrative view showing the positional relationship between a waste toner conveying screw and a vibrating part that form the intermediate transfer belt cleaning device.

Intermediate transfer belt cleaning device 65 according to the first embodiment is provided so as to be extended and in the width direction (the direction of arrow W) of intermediate transfer belt 61, as shown in FIGS. 2 and 3. Intermediate transfer belt cleaning device 65 includes a cleaning blade 651 for removing residual toner from the surface of intermediate transfer belt 61, a waste toner conveying screw 652 for conveying the waste toner collected from intermediate transfer belt 61 by cleaning blade 651, a waste toner conveying screw drive source 653 (FIG. 3) for rotationally driving waste toner conveying screw 652, a vibrating part 654 (FIG. 3) for vibrating the waste toner on cleaning blade 651 and a waste toner conveying pipe 655 (FIG. 3). The thus configured intermediate transfer belt cleaning device 65 conveys the collected waste toner (residual toner) to an unillustrated collecting container.

As shown in FIG. 2, cleaning blade 651 is extended in the width direction (the direction of W) of intermediate transfer belt 61 and arranged in abutment with the surface of intermediate transfer belt 61, as shown in FIG. 1.

Waste toner conveying screw 652 is formed of a fin (auger) 652*a* having a width in the radial direction, helically extended with the pitch of a predetermined distance as shown in FIGS. 3 and 5. This screw is extended approximately parallel to cleaning blade 651 from one longitudinal end to the other of intermediate transfer belt cleaning device 65.

Arranged at one end of intermediate transfer belt cleaning device 65 is waste toner conveying screw drive source 653, as shown in FIG. 3. Waste toner conveying screw drive source 653 is coupled with one end of waste toner conveying screw 652.

Vibrating part 654 is, as shown in FIGS. 3, 4 and 5, is arranged extending in the longitudinal direction of cleaning blade 651 between cleaning blade 651 and waste toner conveying screw 652. Further, vibrating part 654 is arranged in proximity to cleaning blade 651 and is arranged so as to partly abut waste toner conveying screw 652.

Cleaning blade 651 and vibrating part 654 are attached to the housing of intermediate transfer belt cleaning device 65 by an attachment holder 656 (FIGS. 3 and 4).

Now, vibrating part 654 according to the first embodiment will be described in detail with reference to the drawings.

Figure 6:
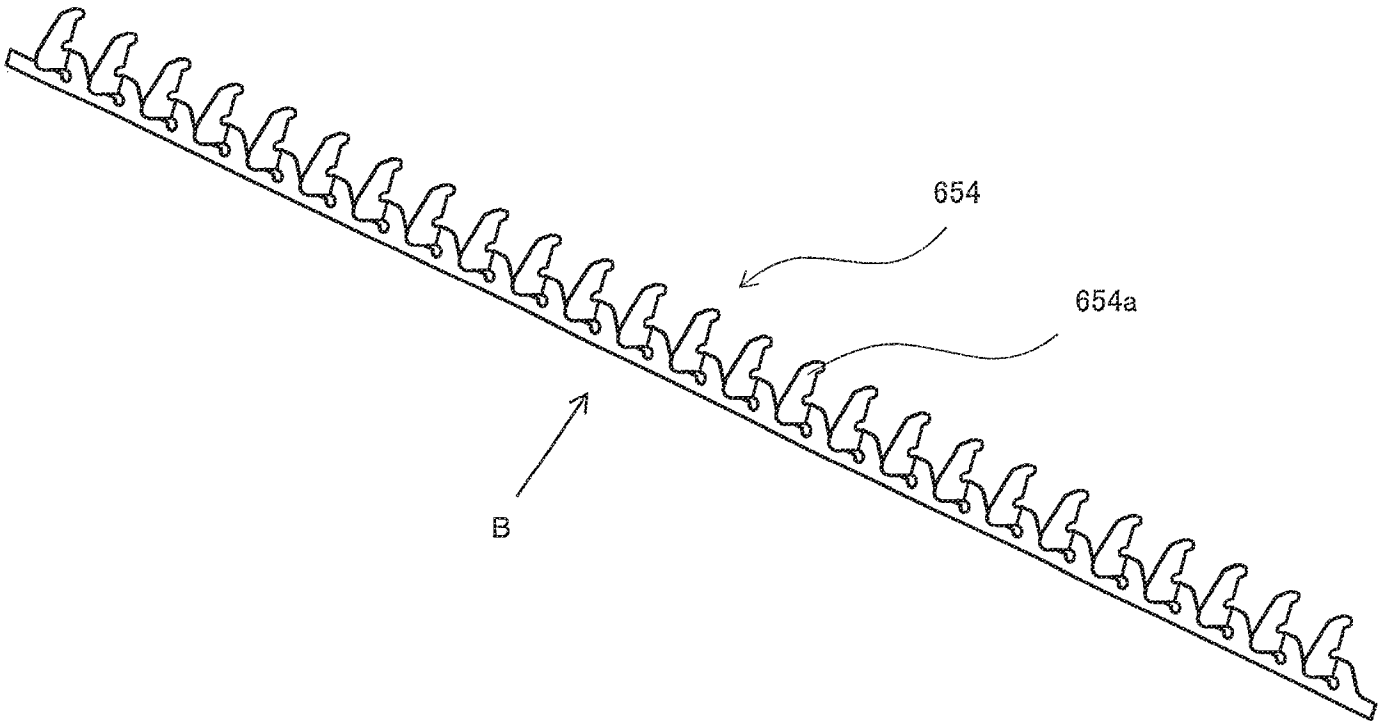
FIG. 6 is a perspective view showing a configuration of a vibrating part that forms the intermediate transfer belt cleaning device.
Figure 7:
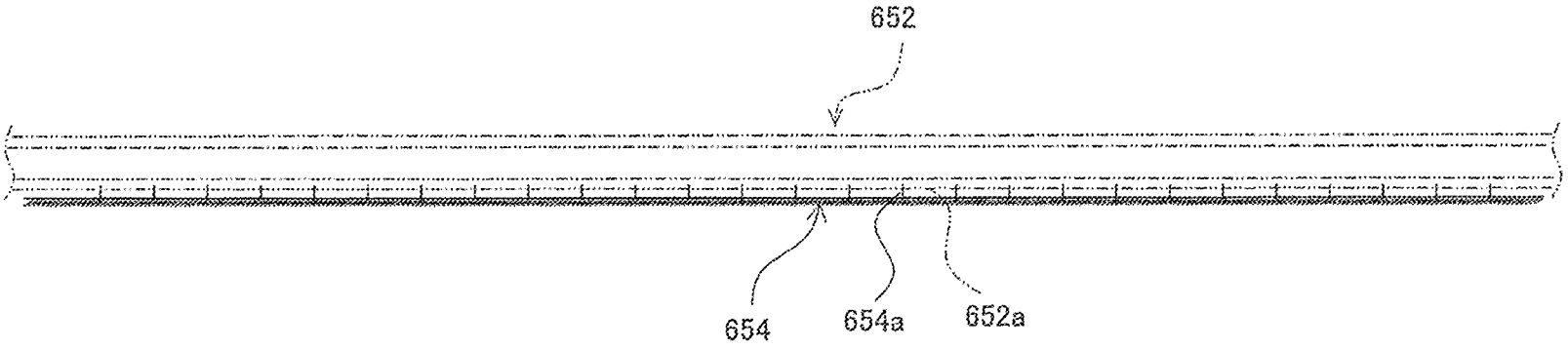
FIG. 7 is a view taken in the direction of arrow A in FIG. 5.
Figure 8:
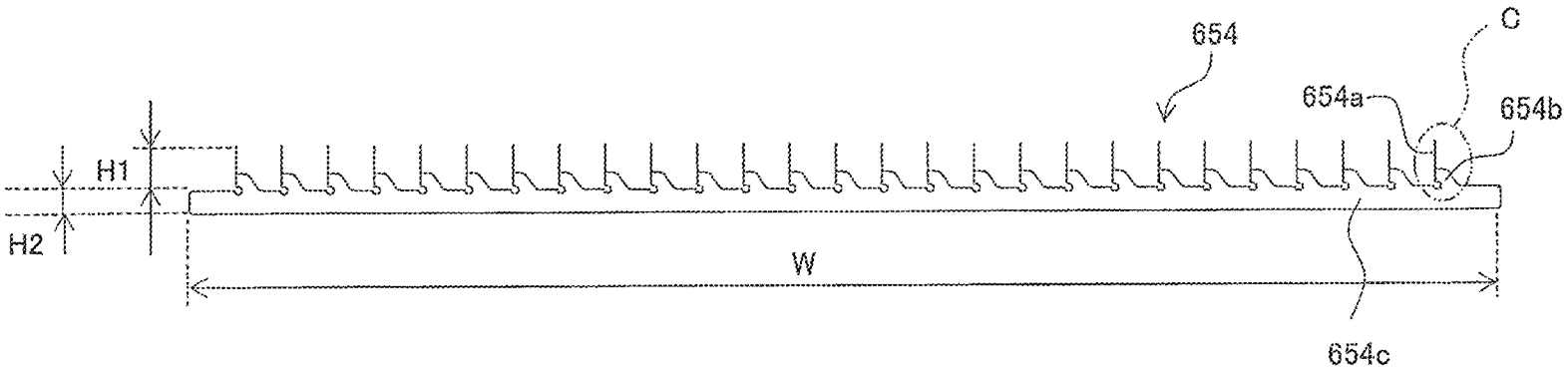
FIG. 8 is a view taken in the direction of arrow B in FIG. 6.
Figure 9:
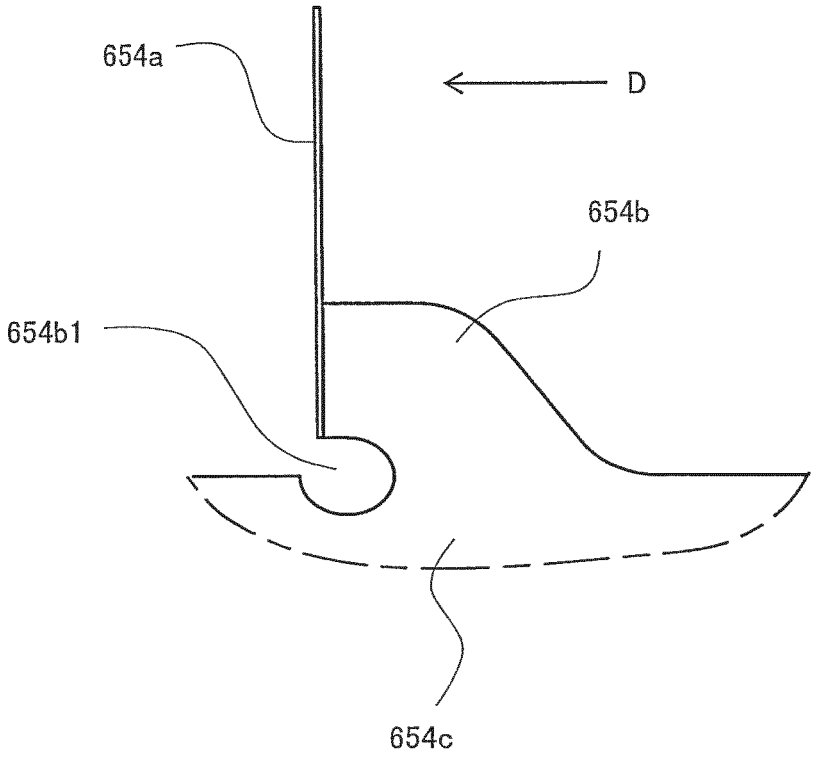
FIG. 9 is a detail view of a portion designated by C in FIG. 8, showing the configuration of a vane that forms the vibrating part.
Figure 10:
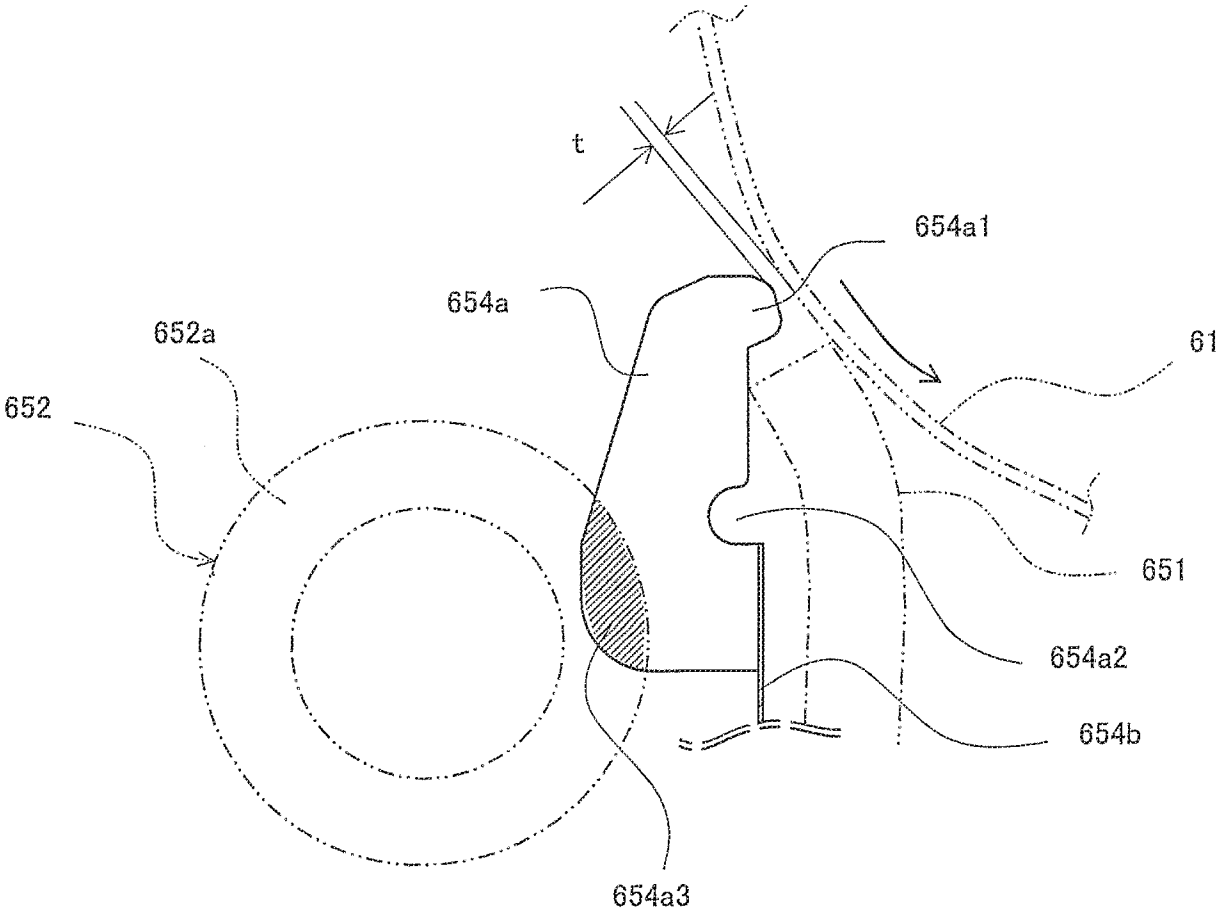
FIG. 10 is a view taken in the direction of arrow D in FIG. 9, showing the structure of the vane.

FIG. 6 is a perspective view showing a configuration of the vibrating part that forms the intermediate transfer belt cleaning device according to the first embodiment. FIG. 7 is a view taken in the direction of arrow A in FIG. 5. FIG. 8 is a view taken in the direction of arrow B in FIG. 6. FIG. 9 is a detail view of a portion designated by C in FIG. 8, showing the configuration of a vane that forms the vibrating part. FIG. 10 is a view taken in the direction of arrow D in FIG. 9, showing the structure of the vane.

Vibrating part 654 is formed of a film sheet. As the material of the film sheet, PET (Polyethylene Terephthalate), polyurethane, stainless steel and the like can be listed. Vibrating part 654 is essentially formed of, as shown in FIGS. 6 to 10, a plurality of vanes 654*a* that abut fin 652*a* of waste toner conveying screw 652, supporting parts 654*b* (FIG. 8) that support individual vanes 654*a* and a base part 654*c* (FIG. 8) that integrally configures plurality of vanes 654*a* and supporting parts 654*b*. The plurality of vanes 654*a*, supporting parts 654*b* and base part 654*c* are formed integrally.

Each vane 654*a* is formed such that its width direction resides in a plane approximately perpendicular to the axial line of waste toner conveying screw 652. The plurality of vanes 654*a* are formed by being bent approximately 90° to the direction in which base part 654*c* is attached as shown in FIGS. 9 and 10, and are arranged comb-like in the longitudinal direction of vibrating part 654, as shown in FIG. 8. Further, as shown in FIGS. 7 and 10, the vibrating part is disposed in such a state that part of vanes 654*a* (the hatched portion 654*a*3 in FIG. 10) comes into the interior space of the envelope of fin 652*a* of waste toner conveying screw 652.

Further, vane 654*a* is formed at its front end with a projected part 654*a*1 that is projected toward intermediate transfer belt 61, as shown in FIG. 10.

Formed at the lower part of the front end of vane 654*a*, or at the boundary between vane 654*a* and supporting part 654*b*, is a circular arced indentation 654*a*2 that is hollowed arcuately, as shown in FIG. 10.

Further, as shown in FIG. 9, another circular arced indentation 654*b*1 that is hollowed arcuately, is formed in the boundary between base part 654*c* and supporting part 654*b*, on the side where vane 654*a* is formed.

Moreover, as shown in FIG. 10 vane 654*a* is shaped such that part of its portion opposing intermediate transfer belt 61 abuts cleaning blade 651 when cleaning blade 651 is put in contact with intermediate transfer belt 61, whereby vane 654*a* is positioned a clearance 't' apart from the belt so that projected part 654*a*1 will not interfere with intermediate transfer belt 61.

That is, vane 654*a* and cleaning blade 651 are arranged so that when cleaning blade 651 is in contact with intermediate transfer belt 61, the edge of vane 654*a* comes in contact with the edge of cleaning blade 651, or vane 654*a* comes into point contact with cleaning blade 651.

In the first embodiment, the front end of vane 654*a* is 0.1 to 0.2 (mm) thick. Clearance t (FIG. 10) between projected part 654*a*1 of vane 654*a* and intermediate transfer belt 61 is specified to be 0.3 to 0.6 (mm) when cleaning blade 651 is in abutment with stationary intermediate transfer belt 61.

Further, the plurality of vanes 654*a* are arranged in the axial direction of waste toner conveying screw 652, at intervals of a distance P2 that is different from pitch P1 of fin 652*a*, as shown in FIG. 5.

This arrangement permits smooth change of contact positions of vanes 654*a* with waste toner conveying screw 652 as waste toner conveying screw 652 rotates, whereby it is possible to vibrate vanes 654*a* while the contact area between waste toner conveying screw 652 and vanes 654*a* is being reduced.

Now, one example of production method of vibrating part 654 will be given.

As an example, vibrating part 654 is specified as shown in FIG. 8 such that the height H1 of vane 654*a* is 13 (mm), the height H2 of base part 654*c* is 6 (mm) and the width W of vibrating part 654 is 340 (mm).

First, as the aforementioned film sheet, a film strip of 19 (mm) wide and 340 (mm) long is used. A double-sided adhesive tape of 6 (mm) wide and 340 (mm) long is applied to this film strip in the area corresponding to base part 654*c* of vibrating part 654. Next, by use of a Thomson die (punching die) the part of the film strip where the double-sided tape is not applied is punched in a predetermined shape (forming vanes 654*a*, supporting parts 654*b* and others). Then, vanes 654*a* are bent 90° by using a die for bending.

Thus, vibrating part 654 is formed from a film strip.

Next, the cleaning operation of intermediate transfer belt 61 by intermediate transfer belt cleaning device 65 according to the first embodiment will be described in detail.

Cleaning of the intermediate transfer belt 61 surface by intermediate transfer belt cleaning device 65 is implemented in the state in which cleaning blade 651 is abutted against intermediate transfer belt 61. The angle of attachment of cleaning blade 651 to intermediate transfer belt 61 is specified such that the angle formed by cleaning blade 651 and the upstream direction of intermediate transfer belt 61 being conveyed is greater than the angle formed by cleaning blade 651 and the downstream direction of intermediate transfer belt 61 being conveyed.

The residual toner (waste toner) left over on intermediate transfer belt 61 and collected by cleaning blade 651 is accumulated in the interior of intermediate transfer belt cleaning device 65. The thus accumulated waste toner is conveyed toward the unillustrated collecting container as waste toner conveying screw 652 (FIG. 3) rotates.

As waste toner conveying screw 652 rotates, fin 652*a* that opposing a vane 654*a* of vibrating part 654 moves and abuts the vane 654*a*. As waste toner conveying screw 652 further rotates, the vane 654*a* is pressed by fin 652*a* and elastically deformed.

As the vane 654*a* is further pressed and displaced by fin 652*a*, the vane 654*a* comes out from fin 652*a*. At this movement, the vane 654*a* reverts back from the deformed state to the original state by the own elastic force (restoring force) and vibrates.

Since plurality of vanes 654*a* are arrayed along the longitudinal direction of cleaning blade 651, the plurality of vanes 654*a* successively vibrate along the longitudinal direction of cleaning blade 651, whereby the waste toner on cleaning blade 651 around the plurality of vanes 654*a* close to intermediate transfer belt 61 is vibrated and easily moves to the waste toner conveying screw 652 side. As a result, the function of waste toner collection can be promoted.

As described above, according to the first embodiment, the cleaning device for removing residual toner from intermediate transfer belt 61 has vibrating part 654 (FIG. 8) with the plurality of vanes 654*a* between cleaning blade 651 and waste toner conveying screw 652. Each vane 654*a* comes into contact with waste toner conveying screw 652 at its part 654*a*3 (FIG. 10) and is vibrated in linkage with the movement of waste toner conveying screw 652. Each vane 654*a* has projected part 654*a*1 that is positioned close to and projects toward, intermediate transfer belt 61 in the area around which cleaning blade 651 abuts intermediate transfer belt 61. Accordingly, by vibrating vanes 654*a* of vibrating part 654 taking advantage of the rotational action of waste toner conveying screw 652 it is possible to efficiently vibrate, stir and loosen the waste toner that has been scraped by cleaning blade 651 and stays near intermediate transfer belt 61. As a result, the function of waste toner collection can be promoted.

Further, according to the first embodiment, in vibrating part 654, vane 654*a* is formed at its front end with projected part 654*a*1 (FIG. 10) projected toward intermediate transfer belt 61. Thus, projected part 654*a*1 is disposed close to intermediate transfer belt 61 while the position of vibrating part 654 is constrained by the blade thickness of cleaning blade 651, whereby it is possible to efficiently stir waste toner near intermediate transfer belt 61. That is, projected part 654*a*1 opposing intermediate transfer belt 61 is disposed on the upstream side of cleaning blade 651, it is possible to efficiently stir waste toner immediately before passing by cleaning blade 651.

Further, according to the first embodiment, in the configuration of vibrating part 654, vanes 654*a* are formed by being bent approximately 90° to the direction in which base part 654*c* for fixing vibrating part 654 is attached while circular arced indentation 654*a*2 (FIG. 10) is formed in the boundary between vane 654*a* and supporting part 654*b*. As a result, it is possible to stabilize the bent state of vane 654*a*. Further, circular arced indentation 654*b*1 (FIG. 9) is formed in the boundary between base part 654*c* and supporting part 654*b*, on the side where vane 654*a* is formed. As a result it is possible to disperse stress on the bent portion of vane 654*a*.

According to the first embodiment, in vibrating part 654, each vane 654*a* and cleaning blade 651 are arranged so that when cleaning blade 651 is in contact with intermediate transfer belt 61, the edge of vane 654*a* comes in contact with the edge of cleaning blade 651 (that is, vane 654*a* comes into point contact with cleaning blade 651). Accordingly, it is possible to minimize the influence on the motion of vane 654*a*.

Further, according to the first embodiment, since the thickness of the front end of vane 654*a* is specified to be 0.1 to 0.2 (mm), vibrating part 654 will not yield under the weight of the toner and will not flex too much, so that it is possible to adequately remove the toner. Specifying the thickness not greater than 0.2 (mm) makes it possible to sufficiently stir and remove the toner by virtue of the repulsive force of vibrating part 654 having been bent.

Moreover, according to the first embodiment, the clearance t (FIG. 10) between projected part 654*a*1 of vane 654*a* and intermediate transfer belt 61 is specified to be 0.3 to 0.6 (mm) when cleaning blade 651 is in abutment with stationary intermediate transfer belt 61. Accordingly, it is possible to avoid degradation of the output image, which would occur if the front ends of vanes 654*a* touch and scratch intermediate transfer belt 61 as vibrating part 654 vibrates. Further, the clearance is specified to be equal to 0.6 (mm) or below, the front ends of vanes 654*a* can be positioned as close to intermediate transfer belt 61 as possible. As a result, it is possible to efficiently remove waste toner built up in proximity to intermediate transfer belt 61.

Figure 19:
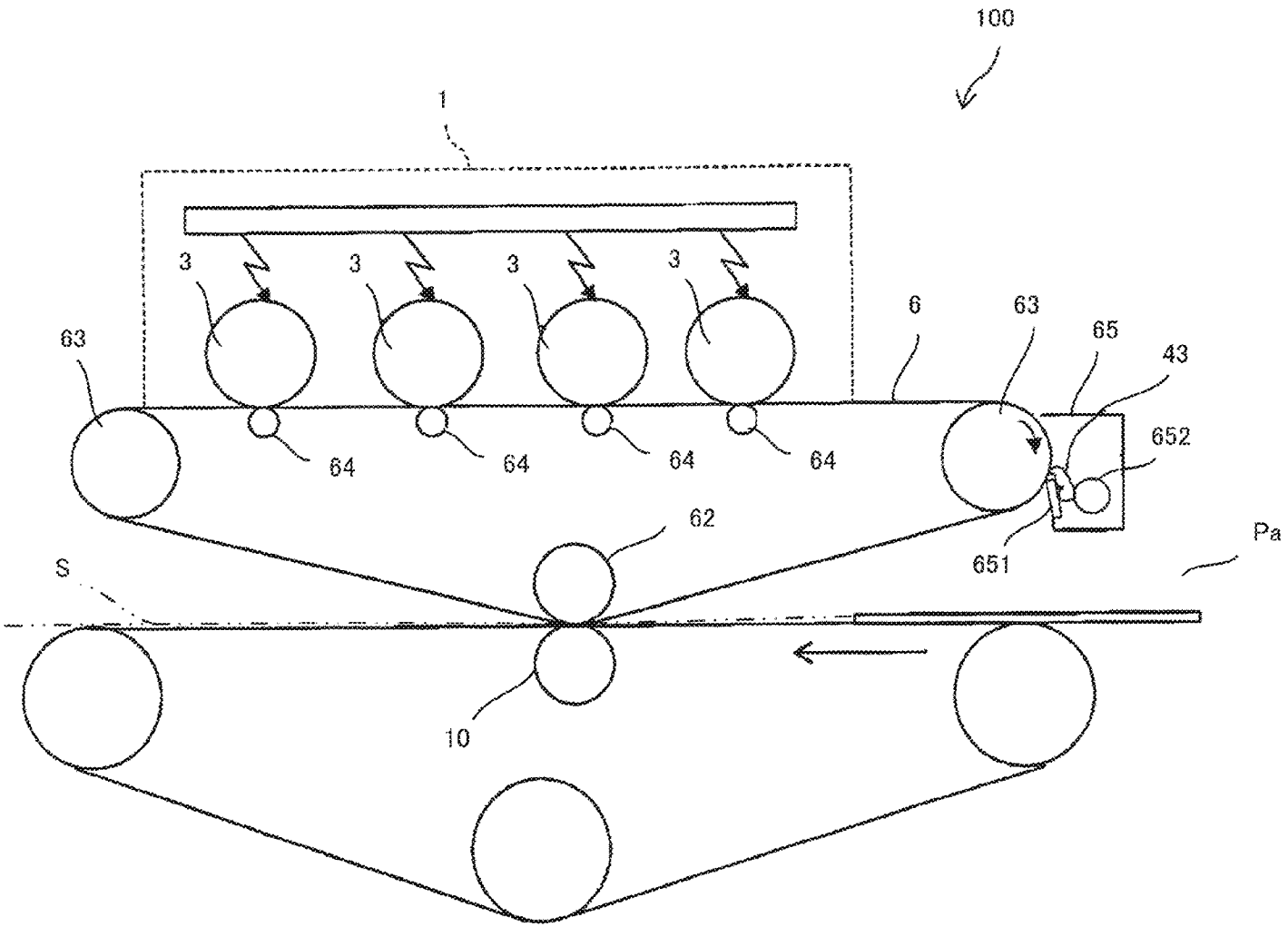

Here, in the present embodiment, in FIG. 1 intermediate transfer belt unit 6 is laid out over exposure unit 1, but the positional relationship of intermediate transfer belt unit 6, exposure unit 1 and others should not be particularly limited. For example, as shown in FIG. 19, intermediate transfer belt unit 6 may be laid out under exposure unit 1.

(The Second Embodiment)

The second embodiment of a cleaning device according to the present invention will be described with reference to the drawings. Herein, the second embodiment will be described by referring to the modified points from the first embodiment.

Figure 11:
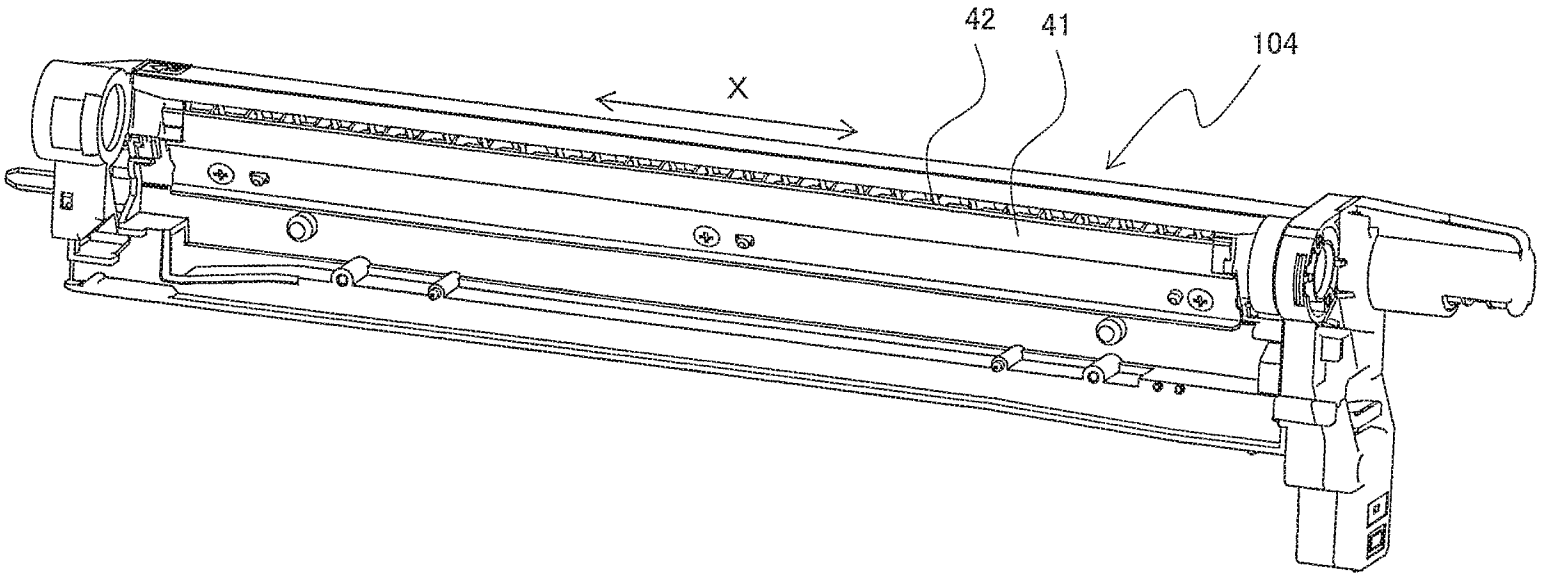
FIG. 11 is a perspective view showing the configuration of a photoreceptor drum cleaning device according to the second embodiment.
Figure 12:
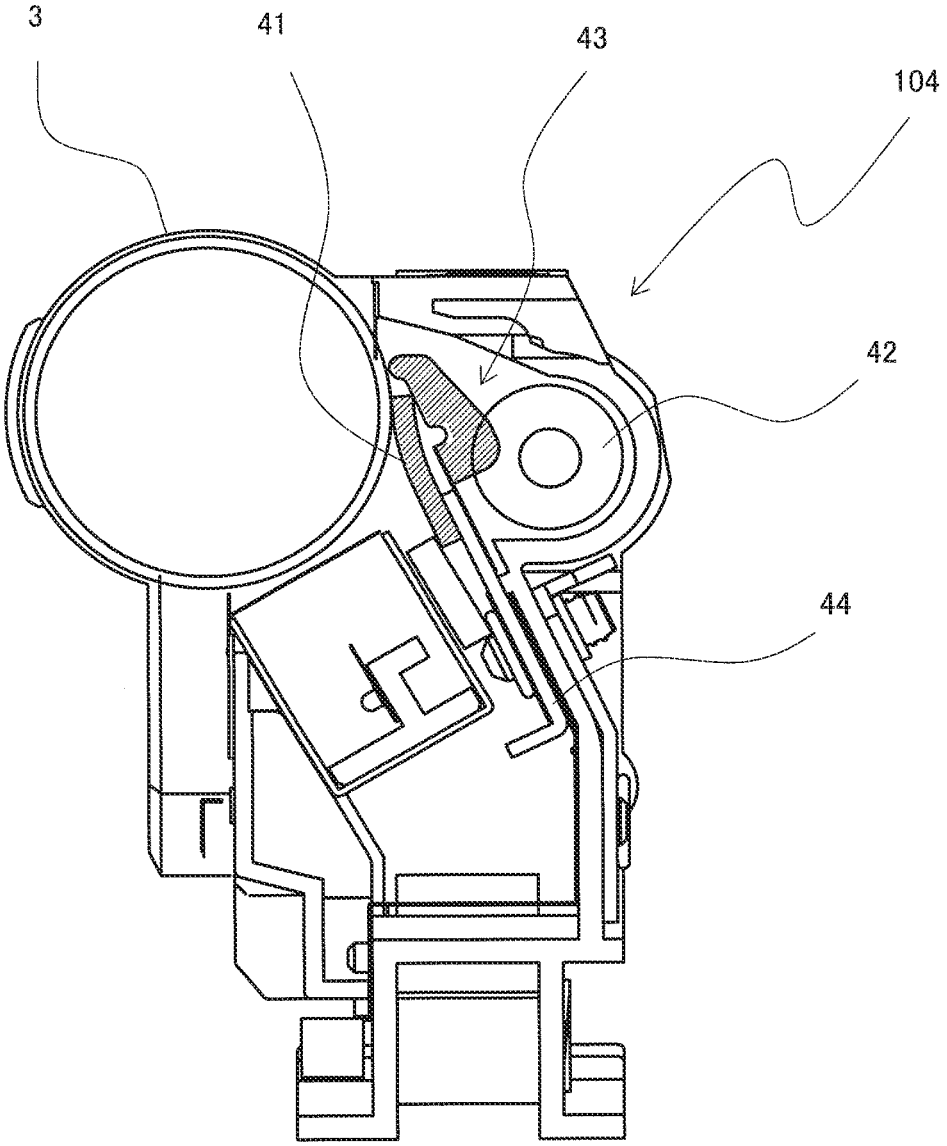
FIG. 12 is a side sectional view showing the internal structure of the photoreceptor drum cleaning device.
Figure 13:
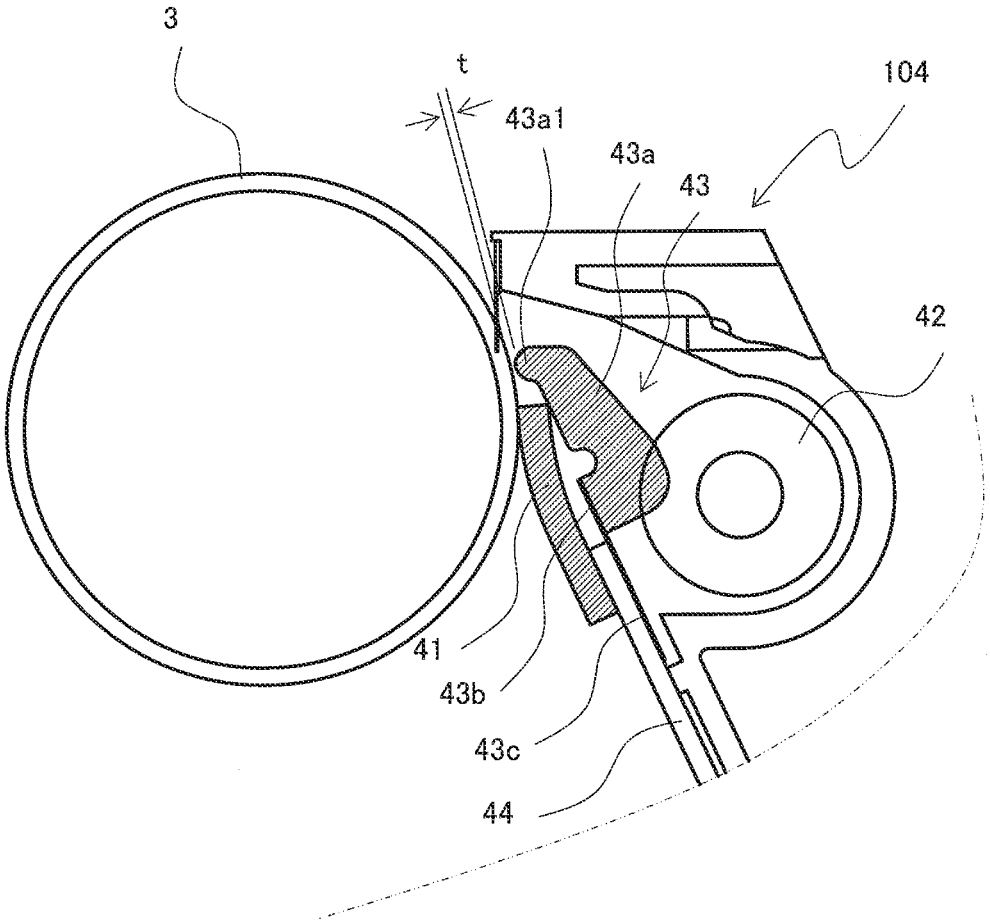
FIG. 13 is a partially enlarged view of the photoreceptor drum cleaning device.
Figure 14:
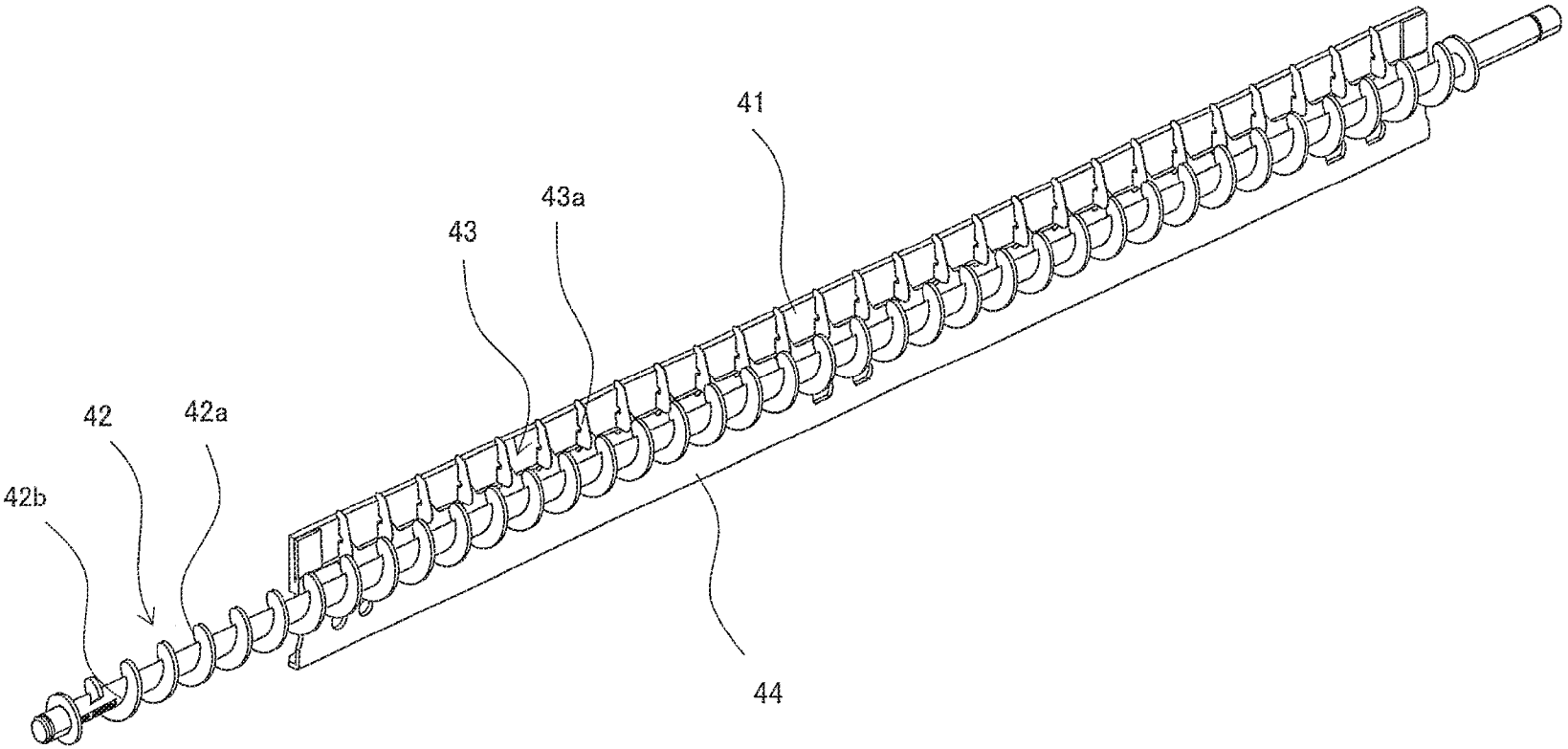
FIG. 14 is an illustrative view showing an attachment state of a cleaning blade, a vibrating part and a waste toner conveying screw that form the photoreceptor drum cleaning device.
Figure 15:
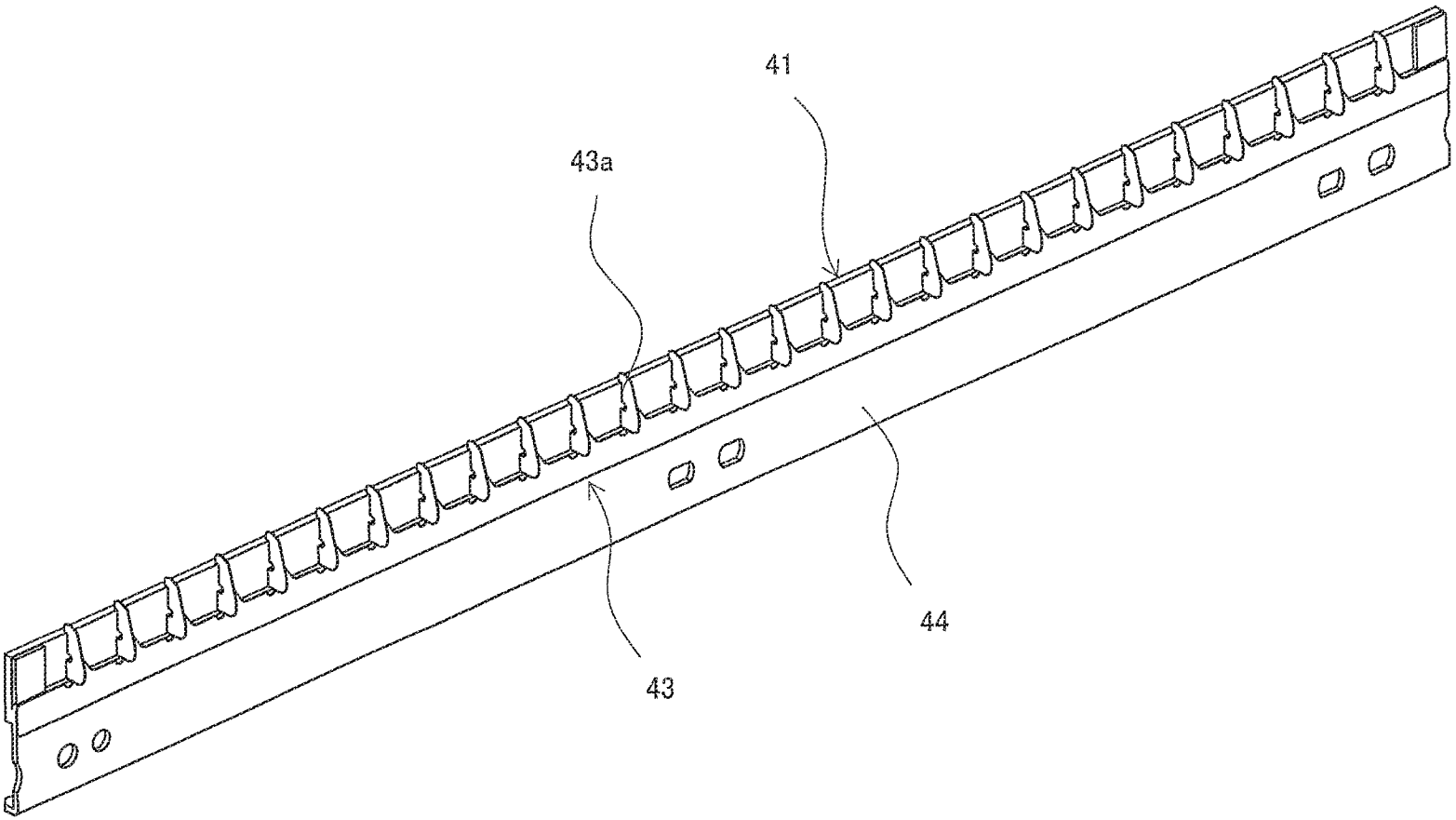
FIG. 15 is an illustrative view showing the positional relationship between the cleaning blade and the vibrating part.
Figure 16:
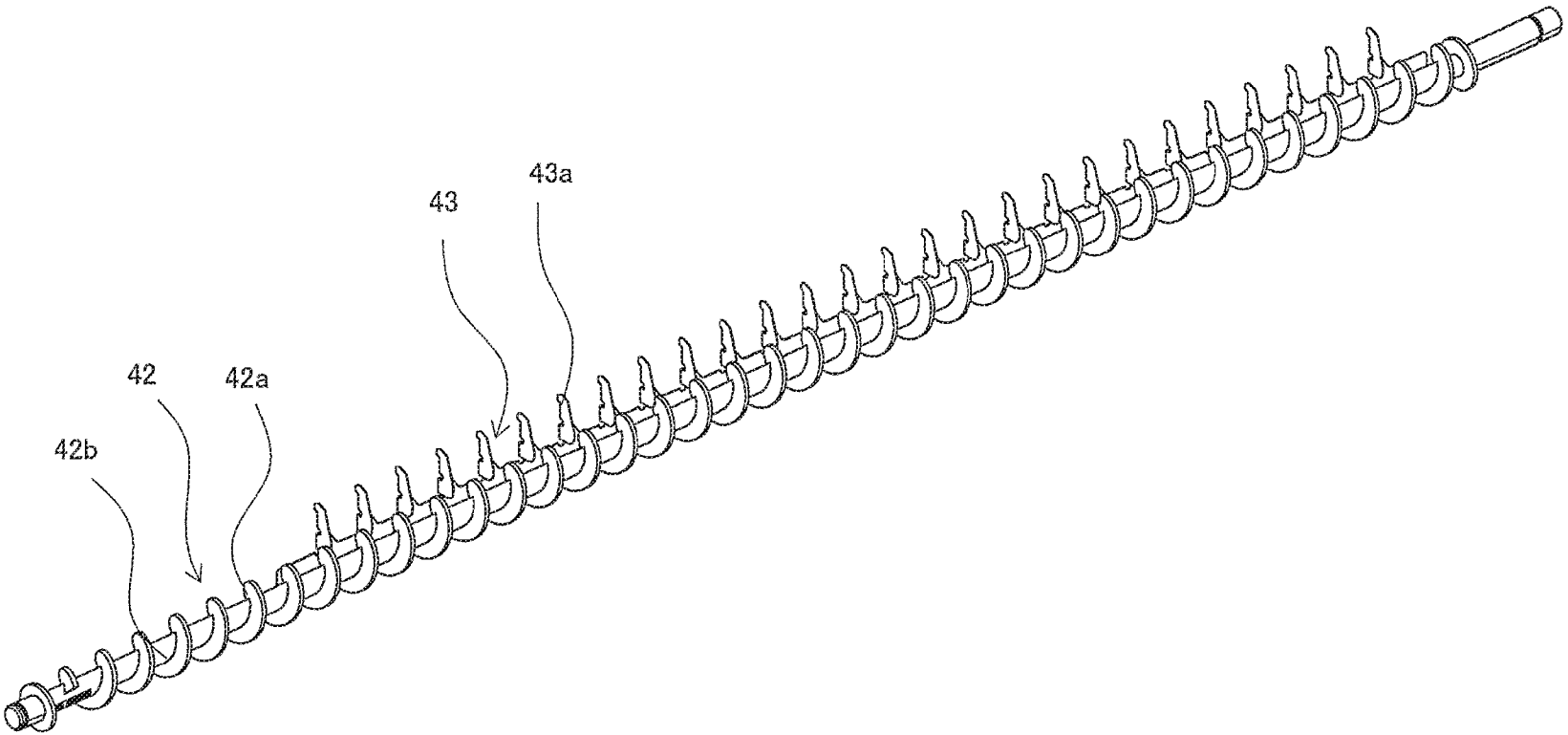
FIG. 16 is an illustrative view showing the positional relationship between the vibrating part and the waste toner conveying screw.
Figure 17:
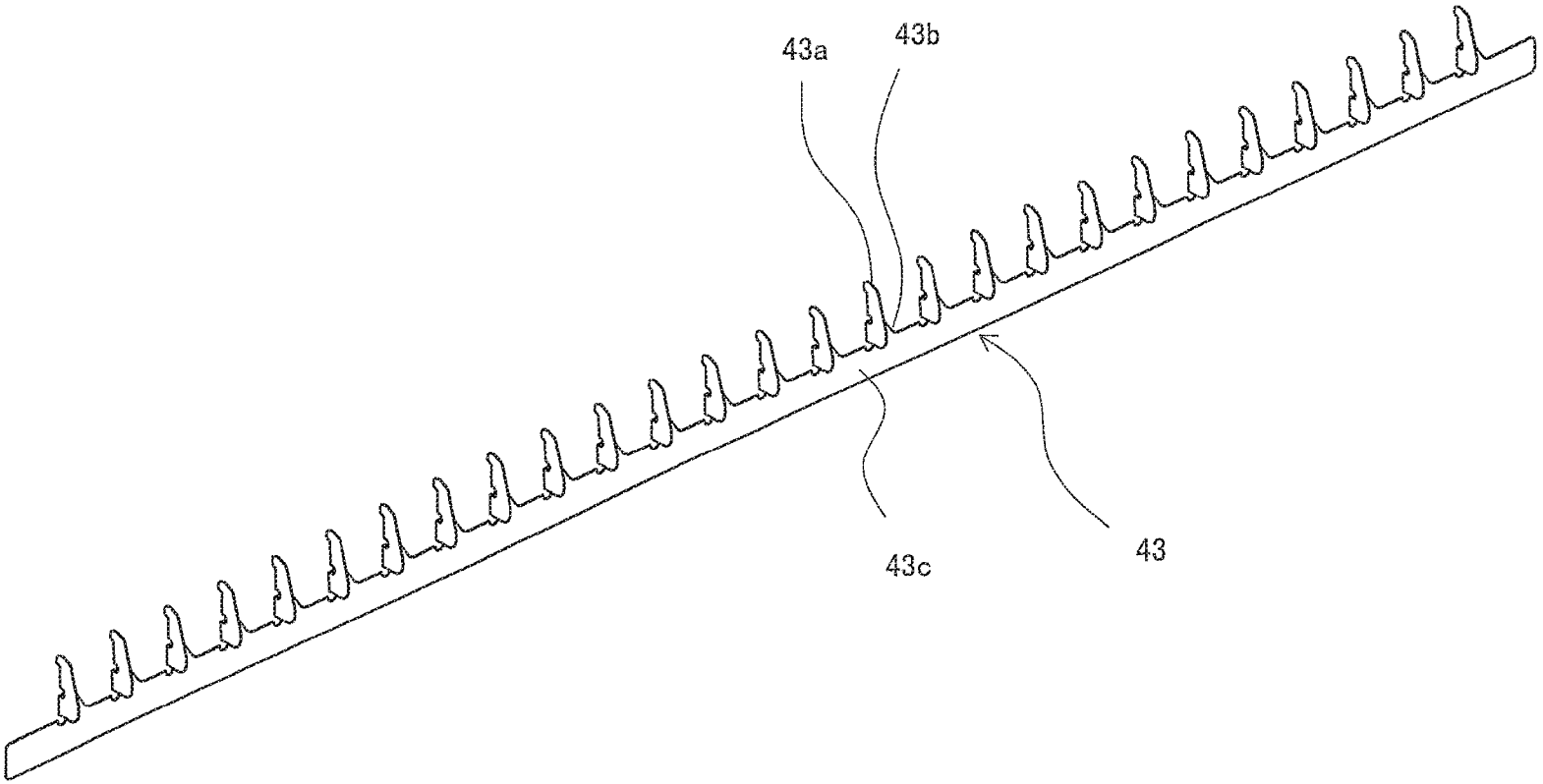
FIG. 17 is a perspective view showing a configuration of the vibrating part.

FIG. 11 is a perspective view showing a configuration of a photoreceptor drum cleaning device according to the second embodiment. FIG. 12 is a side sectional view showing the internal structure of the photoreceptor drum cleaning device. FIG. 13 is a partially enlarged view of the photoreceptor drum cleaning device. FIG. 14 is an illustrative view showing an attachment state of a cleaning blade, a vibrating part and a waste toner conveying screw that form the photoreceptor drum cleaning device. FIG. 15 is an illustrative view showing the positional relation ship between the cleaning blade and the vibrating part. FIG. 16 is an illustrative view showing the positional relationship between the vibrating part and the waste toner conveying screw. FIG. 17 is a perspective view showing a configuration of the vibrating part.

The second embodiment presents the image forming apparatus 100 shown in FIG. 1 in which cleaner unit 4 for cleaning the surface of photoreceptor drum 3 as a toner image bearer is replaced by a photoreceptor drum cleaning device 104 that is a cleaning device of the present invention. photoreceptor drum cleaning device 104 is provided so as to extend in the axial direction of photoreceptor drum 3, as shown in FIGS. 11, 12 and 13. photoreceptor drum cleaning device 104 includes a cleaning blade 41 for removing residual toner from the surface of photoreceptor drum 3, a waste toner conveying screw 42 for conveying the waste toner collected from photoreceptor drum 3 by cleaning blade 41, a waste toner conveying screw drive source (not shown) for rotationally driving waste toner conveying screw 42, a vibrating part 43 (FIGS. 12, 13) for vibrating the waste toner on cleaning blade 41 and a waste toner conveying pipe (not shown). The thus configured photoreceptor drum cleaning device 104 removes residual toner on the surface of photoreceptor drum 3 after development and image transfer and conveys the collected residual toner (waste toner) to an unillustrated collecting container.

As shown in FIG. 11, cleaning blade 41 is extended in the width direction (the direction of X) of photoreceptor drum 3 and arranged in abutment with the surface of photoreceptor drum 3, as shown in FIGS. 12 and 13.

Waste toner conveying screw 42 is formed of a fin (auger) 42*a* having a width in the radial direction, helically extended on the peripheral side of a shaft 42*b* with the pitch of a predetermined distance as shown in FIG. 14. This waste toner conveying screw 42 is arranged approximately parallel to cleaning blade 41 from one longitudinal end to the other of photoreceptor drum cleaning device 104, as shown in FIG. 11.

The unillustrated waste toner conveying screw drive source and waste toner conveying pipe have approximately the same configurations and the same functions as those of the waste toner conveying screw drive source 653 and waste toner conveying pipe 655 described in the first embodiment.

Vibrating part 43 is, as shown in FIG. 14, is arranged extending in the longitudinal direction of cleaning blade 41 between cleaning blade 41 and waste toner conveying screw 42. Further, vibrating part 43 is arranged in proximity to cleaning blade 41 and is arranged so as to partly abut waste toner conveying screw 42, as shown in FIG. 13.

Cleaning blade 41 and vibrating part 43 are attached to the housing of photoreceptor drum cleaning device 104 by an attachment holder 44 (FIGS. 12 to 15).

Next, vibrating part 43 characterizing the second embodiment will be described in detail with reference to the drawings.

In the second embodiment, photoreceptor drum cleaning device 104 is constructed such that vibrating part 43 is joined across the length of cleaning blade 41 from one end to the other.

Vibrating part 43 is formed of a film sheet. Vibrating part 43 is essentially formed of, as shown in FIGS. 13 and 17, a plurality of vanes 43*a* that abut fin 42*a* of waste toner conveying screw 42, supporting parts 43*b* that support individual vanes 43*a* and a base part 43*c* that integrally configures the plurality of vanes 43*a* and supporting parts 43*b*. The plurality of vanes 43*a*, supporting parts 43*b* and base part 43*c* are formed integrally.

Each vane 43*a* is formed such that its width direction resides in a plane approximately perpendicular to the axial line of waste toner conveying screw 42. The plurality of vanes 43*a* are formed by being bent approximately 90° to the direction in which base part 43*c* is attached as shown in FIGS. 13, 16 and 17, and are arranged comb-like in the longitudinal direction of vibrating part 43. Further, as shown in FIGS. 13 and 16, the vibrating part is disposed in such a state that part of vanes 43*a* comes into the interior space of the envelope of fin 42*a* of waste toner conveying screw 42.

Further, vane 43*a* is formed at its front edge with a projected part 43*a*1 that is projected toward photoreceptor drum 3, as shown in FIG. 13.

Other configurations of the parts of vibrating part 43 are the same as those of vibrating part 654 of the first embodiment, so that description is omitted.

As to the attachment of vibrating part 43 and cleaning blade 41, similarly to the first embodiment, vane 43*a* is shaped such that part of its portion opposing photoreceptor drum 3 abuts cleaning blade 41 when cleaning blade 41 is put in contact with photoreceptor drum 3 as shown in FIG. 13, whereby vane 43*a* is positioned a clearance 't' apart so that projected part 43*a*1 will not interfere with photoreceptor drum 3.

That is, vane 43*a* and cleaning blade 41 are arranged so that when cleaning blade 41 is in contact with photoreceptor drum 3, the edge of vane 43*a* comes in contact with the edge of cleaning blade 41 (that is, vane 43*a* comes into point contact with cleaning blade 41).

In the second embodiment, similarly to the first embodiment the front end of vane 43*a* is 0.1 to 0.2 (mm) thick. Clearance t between projected part 43*a*1 of vane 43*a* and photoreceptor drum 3 is specified to be 0.3 to 0.6 (mm) when cleaning blade 41 is in abutment with stationary photoreceptor drum 3.

Next, the cleaning operation of photoreceptor drum 3 by photoreceptor drum cleaning device 104 according to the second embodiment will be described in detail.

Cleaning of the photoreceptor drum 3 surface by photoreceptor drum cleaning device 104 is implemented in the state in which cleaning blade 41 is abutted against photoreceptor drum 3. The angle of attachment of cleaning blade 41 to photoreceptor drum 3 is specified such that the angle formed by cleaning blade 41 and the upstream direction angle formed by cleaning blade 41 and the downstream direction of photoreceptor drum 3 being rotated.

The residual toner (waste toner) left over on photoreceptor drum 3 and collected by cleaning blade 41 is accumulated in the interior of photoreceptor drum cleaning device 104. The thus accumulated waste toner is conveyed toward the unillustrated collecting container as waste toner conveying screw 42 rotates.

As waste toner conveying screw 42 rotates, fin 42*a* that opposing a vane 43*a* of vibrating part 43 moves and abuts the vane 43*a*. As waste toner conveying screw 42 further rotates, the vane 43*a* is pressed by fin 42*a* and elastically deformed.

As the vane 43*a* is further pressed and displaced by fin 42*a*, the vane 43*a* comes out from fin 42*a*. At this movement, the vane 43*a* reverts back from the deformed state to the original state by the own elastic force (restoring force) and vibrates.

Since the plurality of vanes 43*a* are arrayed along the longitudinal direction of cleaning blade 41, the plurality of vanes 43*a* successively vibrate along the longitudinal direction of cleaning blade 41, whereby the waste toner on cleaning blade 41 around the plurality of vanes 43*a* close to photoreceptor drum 3 is vibrated and easily moves to the waste toner conveying screw 42 side. As a result, the function of waste toner collection can be promoted.

Now, the test result on the performance of cleaning residual toner on photoreceptor drum 3 by photoreceptor drum cleaning device 104 in image forming apparatus 100 of the second embodiment will be explained.

The evaluation was made by performing aging tests of photoreceptor drum cleaning device 104 of the second embodiment and a conventional photoreceptor drum cleaning device on the rear machine on the real machines under an environment of high temperature (35 deg.C) and low humidity (5%) in which cleaning failure due to packing is liable to occur. Here, packing indicates a phenomenon occurring during conveyance of waste toner, that particles of waste toner become packed by the pressure of waste toner being conveyed so that the waste toner particles become further packed and aggregate.

Figure 18:
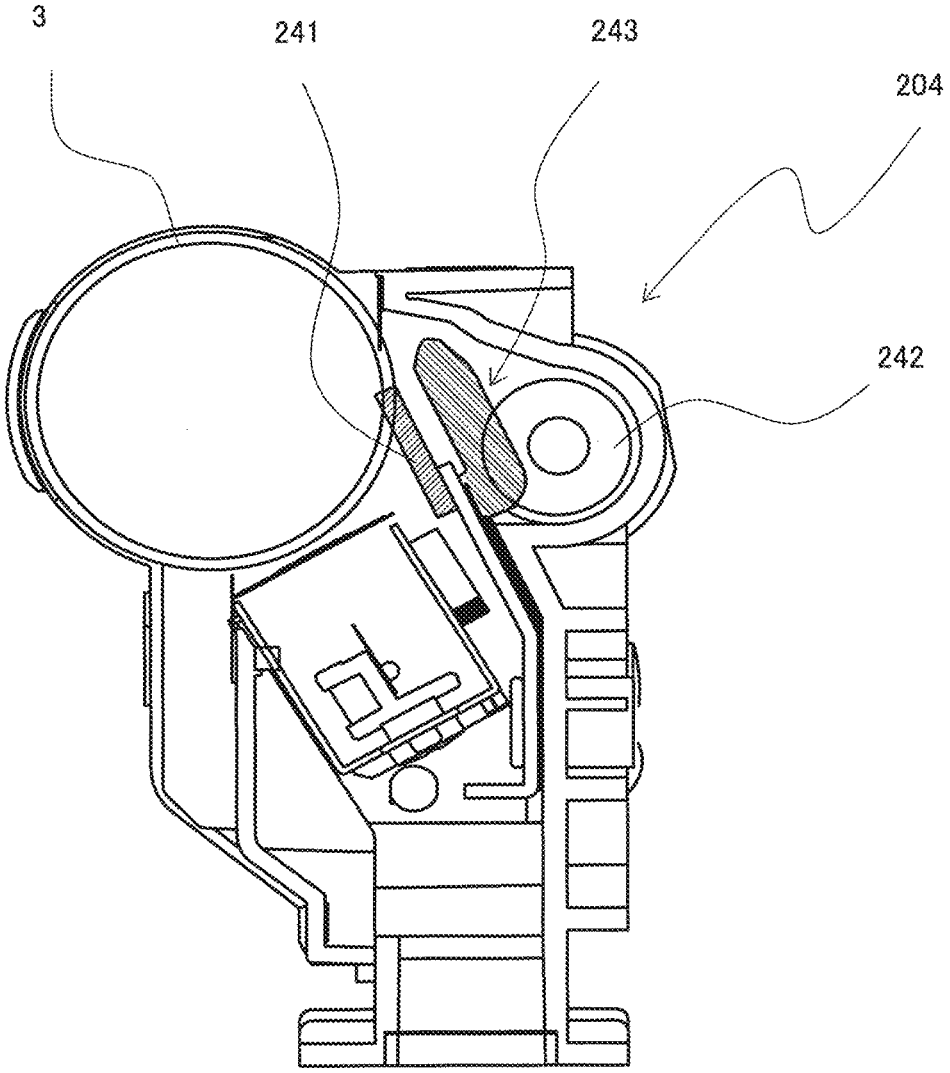
FIG.18 Related Art
FIG. 18 is an illustrative view showing one example of a conventional photoreceptor drum cleaning device configuration; and, FIG. 19 is an illustrative diagram showing another configuration of an image forming apparatus using a cleaning device according to the first embodiment of the present invention.

A conventional photoreceptor drum cleaning device 204 is provided so as to extend in the axial direction of photoreceptor drum 3, as shown in FIG. 18, and includes a cleaning blade 241 for removing residual toner from the surface of photoreceptor drum 3, a waste toner conveying screw 242 for conveying the waste toner collected from photoreceptor drum 3 by cleaning blade 241 and a vibrating part 243 for vibrating the waste toner collected by cleaning blade 241.

As a result of the tests, photoreceptor drum cleaning device 104 of the second embodiment of the present invention could produce fine images free from cleaning failures up to 130 K or more, in excess of 100 K (1K=1000 sheets), the expected life. In contrast, in the conventional cleaning device, image quality defect due to packing occurred at 70 K.

Further, when each cleaning device was observed by taking off the photoreceptor drum to check the condition of waste toner, the waste toner around photoreceptor drum 3 has been effectively removed in photoreceptor drum cleaning device 104 of the second embodiment so that no packing was found. On the other hand, in the conventional photoreceptor drum cleaning device 204 some aggregates of toner particles near photoreceptor drum 3 which could not be loosened by vibrating part 243 were found.

As described above, according to the second embodiment, the cleaning device for removing residual toner remaining on photoreceptor drum 3 has vibrating part 43 with the plurality of vanes 43*a* between cleaning blade 41 and waste toner conveying screw 42. Each vane 43*a* partly comes into contact with waste toner conveying screw 42 and vibrates in linkage with the movement of waste toner conveying screw 42. Each vane 43*a* has projected part 43*a*1 that is positioned close to, and projects toward, photoreceptor drum 3 in the area around which cleaning blade 41 abuts photoreceptor drum 3. Accordingly, by vibrating vanes 43*a* of vibrating part 43 taking advantage of the rotational action of waste toner conveying screw 42 it is possible to efficiently vibrate, stir and loosen the waste toner that has been scraped by cleaning blade 41 and stays near photoreceptor drum 3. As a result, the function of waste toner collection can be promoted.

That is, according to the second embodiment, cleaning blade 41, waste toner conveying screw 42 and vibrating part 43 that form photoreceptor drum cleaning device 104 are configured in the same structure as that of cleaning blade 651, waste toner conveying screw 652 and vibrating part 654 that form intermediate transfer belt cleaning device 65 of the first embodiment. Accordingly, the same function and effect for intermediate transfer belt 61 can be obtained for photoreceptor drum 3.

Though in the above first and second embodiments, intermediate transfer belt cleaning device 65 and photoreceptor drum cleaning device 104 for use in the electrophotographic image forming apparatus capable of color image forming were described, the present invention should not be limited to the image forming apparatus of the above described configuration, but can be applied to image forming apparatus of other configurations. For example, the present invention can also be applied to an electrophotographic image forming apparatus cable of monochrome image forming only.

As has been described, the present invention is not limited to the above embodiments, but various changes can be made within the scope of the appended claims. That is, any embodied mode obtained by combination of technical means modified as appropriate without departing from the spirit and scope of the present invention should be included in the technical art of the present invention.

What is claimed is:

1. A cleaning device for cleaning a toner image bearer that supports toner images in an image forming apparatus for forming images by electrophotography, comprising:

a cleaning member for removing residual toner on the surface of the toner image bearer;

a waste toner conveying member for conveying the residual toner removed from the toner image bearer by the cleaning member; and, a vibrating member having a plurality of vanes, disposed between the cleaning member and the waste toner conveying member, the vanes partly coming into contact with the waste toner conveying member and vibrating in linkage with the motion of the waste toner conveying member, and, wherein the individual vanes include a projected part that is positioned close to, and projects toward, the toner image bearer, in the area around which the cleaning member abuts the toner image bearer.

2. The cleaning device according to claim 1, wherein the vibrating member includes supporting parts that support the individual vanes; and, a base part that integrally configures the plurality of vanes and the supporting parts along the waste toner conveying member, and, the vibrating member has a circular arced indentation formed at a boundary between the individual vanes and the supporting part.

3. The cleaning device according to claim 2, wherein the vibrating member has a circular arced indentation formed at a boundary between each of the supporting parts and the base part.

4. The cleaning device according to claim 1, wherein the individual vanes is formed of a plane approximately perpendicular to the longitudinal direction of the waste toner conveying member, and, when the cleaning member is put in contact with the toner image bearer, the individual vanes is arranged at the position that the projected part does not interfere with the toner image bearer by abutting part of its portion opposing the toner image bearer to the cleaning member.

5. The cleaning device according to claim 4, wherein the abutment between the individual vanes and the cleaning member is such that when cleaning member is in contact with the toner image bearer, the edge of the individual vanes come in contact with the edge of the cleaning member.

6. An image forming apparatus comprising:

an image forming portion for forming images by electrophotography; and, a cleaning device including a cleaning member for removing residual toner on the surface of a toner image bearer that supports a toner image, and a waste toner conveying member for conveying the residual toner removed from the toner image bearer by the cleaning member, and, wherein the cleaning device according to claim 1 is employed as the cleaning device.

* * * * *